US010743620B2

(12) United States Patent
Pheil et al.

(10) Patent No.: US 10,743,620 B2
(45) Date of Patent: Aug. 18, 2020

(54) AUTOMATED TENSIONING SYSTEM FOR AN ARTICLE OF FOOTWEAR

(71) Applicant: NIKE, Inc., Beaverton, OR (US)

(72) Inventors: Holli Pheil, Portland, OR (US); Tiffany A. Beers, Portland, OR (US); Andrew A. Owings, Portland, OR (US); Ryan Frederick, Seattle, WA (US); Austin Palmer, Seattle, WA (US); Michael Ciuffo, Seattle, WA (US); Steven H. Walker, Camas, WA (US)

(73) Assignee: NIKE, Inc., Beaverton, OR (US)

( * ) Notice: Subject to any disclaimer, the term of this patent is extended or adjusted under 35 U.S.C. 154(b) by 404 days.

(21) Appl. No.: 14/955,705

(22) Filed: Dec. 1, 2015

(65) Prior Publication Data

US 2016/0345681 A1 Dec. 1, 2016

Related U.S. Application Data

(60) Provisional application No. 62/167,881, filed on May 28, 2015.

(51) Int. Cl.

| | |
|---|---|
| ***A43C 11/16*** | (2006.01) |
| ***A43B 3/00*** | (2006.01) |
| ***A43C 1/00*** | (2006.01) |
| ***A43B 11/00*** | (2006.01) |

(52) U.S. Cl.

CPC ..... *A43C 11/165* (2013.01); *A43B 3/0005* (2013.01); *A43B 11/00* (2013.01); *A43C 1/00* (2013.01); *A43C 11/16* (2013.01)

(58) Field of Classification Search

CPC ..... A43B 3/0005; A43B 3/001; A43C 11/00; A43C 11/16; A43C 11/165

See application file for complete search history.

(56) References Cited

U.S. PATENT DOCUMENTS

| | | | |
|---|---|---|---|
| 4,466,204 | A | 8/1984 | Wu |
| 4,848,009 | A | 7/1989 | Rodgers |
| 5,592,759 | A | 1/1997 | Cox |

(Continued)

FOREIGN PATENT DOCUMENTS

| | | | |
|---|---|---|---|
| CN | 102014682 | A | 4/2011 |
| CN | 107847005 | A | 3/2018 |

(Continued)

OTHER PUBLICATIONS

"International Application Serial No. PCT/US2016/032274, International Preliminary Report on Patentability dated Dec. 7, 2017", 5 pgs.

(Continued)

*Primary Examiner* — Sharon M Prange

(74) *Attorney, Agent, or Firm* — Schwegman Lundberg & Woessner, P.A.

(57) ABSTRACT

An article of footwear can include provisions for improving the operation and use of various systems associated with the article. An automated tensioning system can be configured to provide and perform a variety of functions associated with the fastening of the article of footwear. The automated tensioning system may tighten and loosen the article of footwear through the operation of a motor. The automated tensioning system may also be able to store and recall a preset tension level.

27 Claims, 23 Drawing Sheets

(56) References Cited

U.S. PATENT DOCUMENTS

| | | | | |
|---|---|---|---|---|
| 5,765,300 | A | 6/1998 | Kianka | |
| 6,691,433 | B2 | 2/2004 | Liu | |
| 6,788,200 | B1 | 9/2004 | Jamel et al. | |
| 7,210,253 | B2 | 5/2007 | Yu | |
| 7,225,565 | B2 | 6/2007 | DiBenedetto et al. | |
| 7,254,910 | B2 | 8/2007 | Guzman | |
| 7,596,891 | B2 | 10/2009 | Carnes et al. | |
| 7,607,243 | B2 | 10/2009 | Berner, Jr. et al. | |
| 7,789,520 | B2 | 9/2010 | Konig et al. | |
| 7,794,101 | B2 | 9/2010 | Galica et al. | |
| 7,798,682 | B1 * | 9/2010 | Cvek | F21S 2/00 362/257 |
| 8,056,269 | B2 | 11/2011 | Beers et al. | |
| 8,058,337 | B2 | 11/2011 | Beers et al. | |
| 8,086,421 | B2 | 12/2011 | Case, Jr. et al. | |
| 8,087,188 | B2 * | 1/2012 | Labbe | A43B 11/00 24/712 |
| 8,234,798 | B2 | 8/2012 | DiBenedetto et al. | |
| 8,384,551 | B2 | 2/2013 | Ross et al. | |
| 8,628,453 | B2 | 1/2014 | Balakrishnan et al. | |
| 8,728,024 | B2 * | 5/2014 | Kamen | A61M 39/14 604/65 |
| 8,771,148 | B2 | 7/2014 | Balakrishnan et al. | |
| 8,879,685 | B2 | 11/2014 | Oshio | |
| 8,935,860 | B2 | 1/2015 | Torres | |
| 8,938,892 | B2 | 1/2015 | Case, Jr. | |
| 2003/0070324 | A1 | 4/2003 | Nelson | |
| 2006/0156588 | A1 | 7/2006 | Ferrell | |
| 2007/0130804 | A1 | 5/2007 | Levy et al. | |
| 2008/0203144 | A1 | 8/2008 | Kim | |
| 2009/0272013 | A1 | 11/2009 | Beers et al. | |
| 2010/0223816 | A1 | 9/2010 | Barfield | |
| 2011/0054359 | A1 | 3/2011 | Sazonov et al. | |
| 2011/0107771 | A1 | 5/2011 | Crist et al. | |
| 2011/0175744 | A1 | 7/2011 | Englert et al. | |
| 2011/0225843 | A1 | 9/2011 | Kerns et al. | |
| 2011/0260857 | A1 | 10/2011 | Hamill | |
| 2011/0266384 | A1 | 11/2011 | Goodman et al. | |
| 2012/0000091 | A1 | 1/2012 | Cotterman et al. | |
| 2012/0234111 | A1 | 9/2012 | Molyneux et al. | |
| 2013/0019694 | A1 | 1/2013 | Molyneux et al. | |
| 2013/0130843 | A1 | 5/2013 | Burroughs et al. | |
| 2013/0211290 | A1 | 8/2013 | Lee | |
| 2013/0219754 | A1 | 8/2013 | Nowak et al. | |
| 2014/0057233 | A1 | 2/2014 | Morag et al. | |
| 2014/0068838 | A1 * | 3/2014 | Beers | A61F 5/028 2/243.1 |
| 2014/0070042 | A1 * | 3/2014 | Beers | A61F 5/028 242/413 |
| 2014/0082963 | A1 | 3/2014 | Beers | |
| 2014/0228987 | A1 | 8/2014 | Case, Jr. et al. | |
| 2014/0244009 | A1 | 8/2014 | Mestas | |
| 2014/0249660 | A1 | 9/2014 | Prstojevich | |
| 2014/0257156 | A1 * | 9/2014 | Capra | A61F 5/0102 602/5 |
| 2014/0277632 | A1 | 9/2014 | Walker | |
| 2014/0330409 | A1 | 11/2014 | Case, Jr. et al. | |
| 2014/0358472 | A1 | 12/2014 | Goel et al. | |
| 2015/0059204 | A1 | 3/2015 | Alexander et al. | |
| 2015/0096204 | A1 | 4/2015 | Case, Jr. | |
| 2015/0104772 | A1 | 4/2015 | Goel et al. | |

FOREIGN PATENT DOCUMENTS

| | | | |
|---|---|---|---|
| DE | 202014003652 | U1 | 1/2015 |
| EP | 2253238 | | 11/2010 |
| JP | 2002119498 | | 4/2002 |
| WO | WO-2014036471 | A2 | 3/2014 |
| WO | WO-2016191123 | A1 | 12/2016 |

OTHER PUBLICATIONS

"International Application Serial No. PCT/US2016/032274, International Search Report dated Oct. 18, 2016", 6 pgs.

"International Application Serial No. PCT/US2016/032274, Written Opinion dated Oct. 18, 2016", 8 pgs.

"European Application Serial No. 16728445.4, Response filed Jul. 19, 2018 to Communication to Rules 161(2) and 162 dated Jan. 17, 2018", 19 pgs.

"Chinese Application Serial No. 201680043875.7, Office Action dated Jan. 20, 2020", 9 pgs.

"U.S. Appl. No. 16/834,391, Non Final Office Action dated Jun. 1, 2020".

"U.S. Appl. No. 16/835,504, Non Final Office Action dated Jun. 30, 2020".

* cited by examiner

| | MANUAL CONTROL EVENTS | OPERATION |
|---|---|---|
| 2210 | THE [+] BUTTON IS PRESSED | TIGHTEN |
| 2220 | THE [+] BUTTON IS RELEASED | CEASE TIGHTEN |
| 2230 | THE [-] BUTTON IS PRESSED | LOOSEN |
| 2240 | THE [-] BUTTON IS RELEASED | CEASE LOOSEN |
| 2250 | THE [+] BUTTON AND THE [-] BUTTON ARE PRESSED TOGETHER FOR LESS THAN 2 SECONDS | RETURN TO TIGHTEN PRESET VALUE |
| 2260 | THE [+] BUTTON AND THE [-] BUTTON ARE PRESSED TOGETHER FOR AT LEAST 2 SECONDS | SAVE NEW TIGHTEN PRESET LEVEL |

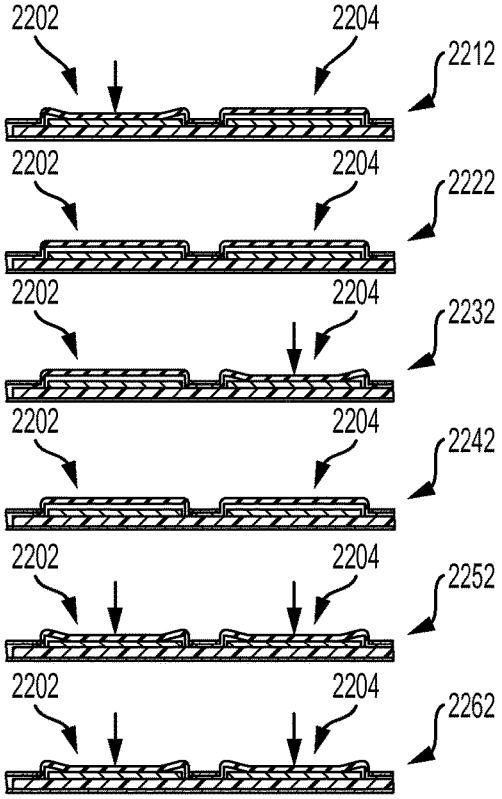

FIG. 22

2402

| | BACKGROUND ANIMATIONS | ASSOCIATED OPERATION |
|---|---|---|
| 2362 | BG_TIGHTEN | DURING TIGHTENING |
| 2372 | BG_LOOSEN | DURING LOOSENING |
| 2430 | BG_UNLACING | DURING (AUTO) UNLACING |
| 2440 | BG_AUTOLACE_COMPLETE | AUTOLACING IS COMPLETED |
| 2450 | BG_RETURN_TO_PRESET_ACK | PRESET RESTORED |

2404

| | FOREGROUND ANIMATIONS | ASSOCIATED OPERATION |
|---|---|---|
| 2460 | FG_STORE_PRESET_ACK | NEW PRESET HAS BEEN SAVED |
| 2470 | FG_STORE_PRESET_NACK | NEW PRESET HAS **NOT** BEEN SAVED |
| 2480 | FG_BATTERY_CHECK_LOW | BATTERY IS LOW |
| 2490 | FG_BATTERY_CHECK_FULL | BATTERY IS FULL |
| 2400 | FG_SOFTWARE_RESET | SOFTWARE HAS BEEN RESET |

FIG. 24

AUTOMATED TENSIONING SYSTEM FOR AN ARTICLE OF FOOTWEAR

RELATED APPLICATION

This application claims the benefit of priority to U.S. Provisional Patent Application Ser. No. 62/167,881, filed on May 28, 2015, which is incorporated by reference herein in its entirety.

BACKGROUND

The present embodiments relate generally to articles of footwear and include removable motorized adjustment systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over the instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to an article of footwear, comprising a motorized tensioning system that is configured to adjust a tension level of the article of footwear from a first tension level to a second tension level, where the first tension level is greater than the second tension level. The motorized tensioning system includes a motor, and there is a first current level associated with operating the motor when the article of footwear is tensioned at the first tension level, and a second current level associated with operating the motor when the article of footwear is tensioned at the second tension level. The first current level is different from the second current level, and the motorized tensioning system is configured to measure current levels that are associated with operation of the motor in order to determine the tension level of the article of footwear.

In another aspect, the present disclosure is directed to an article of footwear, comprising an automated tensioning system that is configured to adjust a level of tension associated with the article of footwear. The automated tensioning system includes a motor, where the motor operates in a first direction and a second direction. The motor operates in the first direction as the level of tension is increased, and the motor operates in the second direction as the level of tension is decreased. In addition, the automated tensioning system determines the level of tension of the article of footwear by measuring a current level that is associated with the motor following operation of the motor in the second direction.

In another aspect, the present disclosure is directed to an article of footwear, comprising a fastening mechanism associated with two or more tension levels and an automated tensioning system configured to adjust the tension level of the fastening mechanism from a first tension level to a second tension level, where the first tension level is different from the second tension level. The automated tensioning system includes a motor. In addition, the automated tensioning system is configured to store the first tension level, and the automated tensioning system is further configured to operate the motor such that the tension level of the fastening mechanism returns to the first tension level automatically.

In another aspect, the present disclosure is directed to a method of automatically adjusting tension in an article of footwear, comprising adjusting a tension level of the article of footwear to a first tension level, measuring a first current level associated with the operation of a motor during the adjustment to the first tension level, and storing the first current level in memory. The method also comprises adjusting the tension level of the article of footwear to a second tension level that is different from the first tension level, and returning the tension level of the article of footwear to the first tension level.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 22 is a schematic chart representing an embodiment of some of the manual control events of a tensioning system;

FIG. 24 is a set of tables representing an embodiment of some of the animations of a tensioning system;

DETAILED DESCRIPTION

Figure 1:
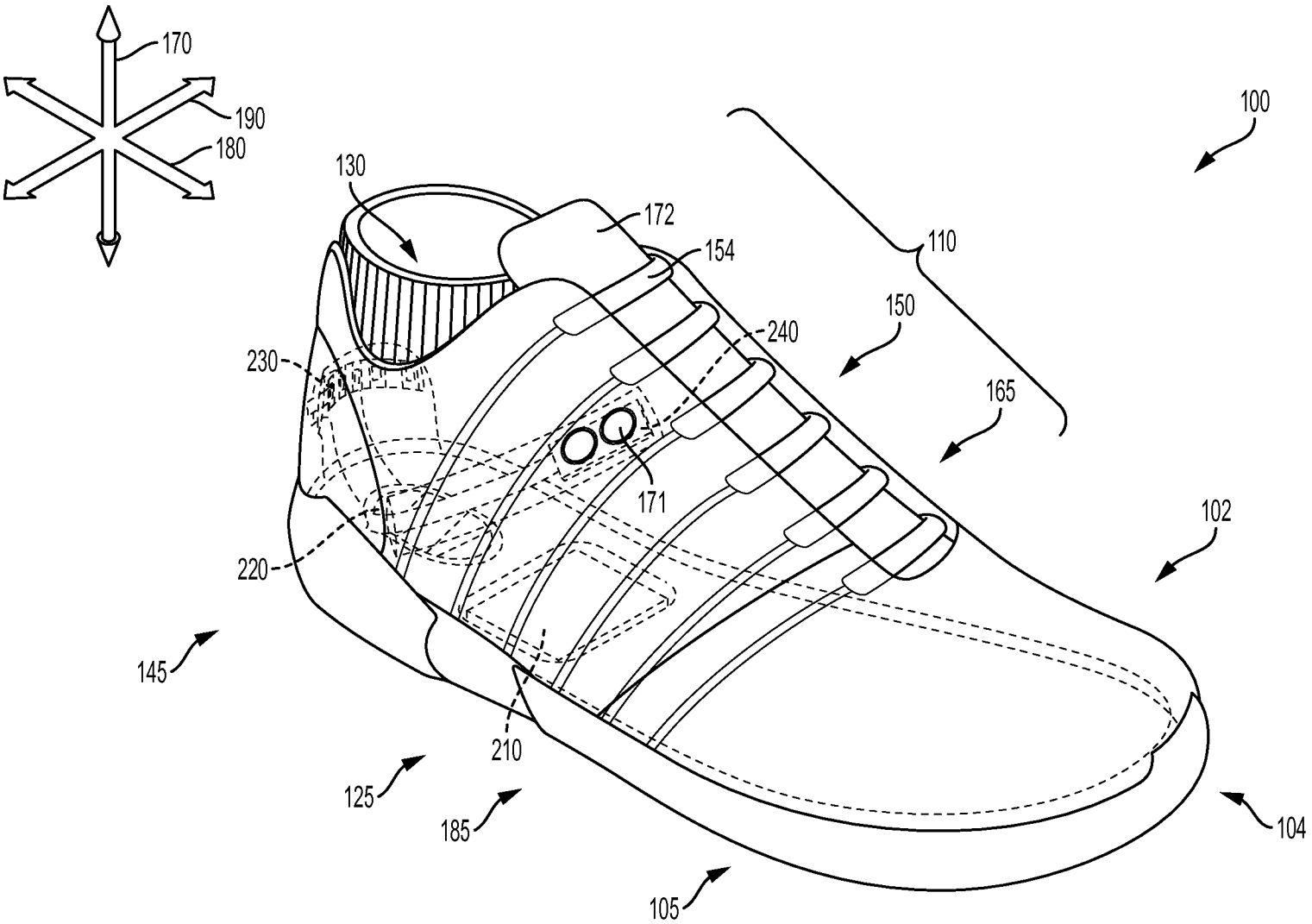
FIG. 1 is a schematic isometric side view of an embodiment of an article of footwear.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

For purposes of clarity, the following detailed description discusses the features of article of footwear 100, also referred to simply as article 100. However, it will be understood that other embodiments may incorporate a corresponding article of footwear (e.g., a left article of footwear when article 100 is a right article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of a midsole structure, an outer sole structure, an upper, or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). A longitudinal direction may extend along a longitudinal axis, which itself extends between a forefoot portion and a heel portion of the component. Also, the term "lateral" as used throughout this detailed description and in the claims refers to a direction extending along a width of a component. A lateral direction may extend along a lateral axis, which itself extends between a medial side and a lateral side of a component. Furthermore, the term "vertical" as used throughout this detailed description and in the claims refers to a direction extending along a vertical axis, which itself is generally perpendicular to a lateral axis and a longitudinal axis. For example, in cases where an article is planted flat on a ground surface, a vertical direction may extend from the ground surface upward. This detailed description makes use of these directional adjectives in describing an article and various components of the article, including an upper, a midsole structure, and/or an outer sole structure.

The term "side," as used in this specification and in the claims, refers to any portion of a component facing generally in a lateral, medial, forward, or rearward direction, as opposed to an upward or downward direction. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

FIG. 1 illustrates a schematic isometric view of an embodiment of article of footwear 100 that is configured with tensioning system 150. In the current embodiment, article of footwear 100, also referred to hereafter simply as article 100, is shown in the form of an athletic shoe, such as a running shoe. However, in other embodiments, tensioning system 150 may be used with any other kind of footwear including, but not limited to, hiking boots, soccer shoes, football shoes, sneakers, running shoes, cross-training shoes, rugby shoes, basketball shoes, baseball shoes as well as other kinds of shoes. Moreover, in some embodiments, article 100 may be configured for use with various kinds of non-sports-related footwear, including, but not limited to, slippers, sandals, high-heeled footwear, loafers as well as any other kinds of footwear. As discussed in further detail below, a tensioning system may not be limited to footwear, and in other embodiments, a tensioning system and/or components associated with a tensioning system could be used with various kinds of apparel, including clothing, sportswear, sporting equipment, and other kinds of apparel. In still other embodiments, a tensioning system may be used with braces, such as medical braces.

As noted above, for consistency and convenience, directional adjectives are employed throughout this detailed description. Article 100 may also be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100 but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to a heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include upper 102 and sole structure 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

As shown in FIG. 1, upper 102 may include one or more material elements (for example, meshes, textiles, foam, leather, and synthetic leather), which may be joined to define an interior void configured to receive a foot of a wearer. The material elements may be selected and arranged to impart properties such as lightweight, durability, air permeability, wear resistance, flexibility, and comfort. Upper 102 may define an opening 130 through which a foot of a wearer may be received into the interior void.

At least a portion of sole structure 104 may be fixedly attached to upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running, or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is hard or soft. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), or soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with a ground surface.

In some embodiments, sole structure 104 may include multiple components, which may individually or collectively provide article 100 with a number of attributes, such as support, rigidity, flexibility, stability, cushioning, comfort, reduced weight, or other attributes. In some embodiments, sole structure 104 may include an insole/sockliner, a midsole, and a ground-contacting outer sole member ("outsole"), which may have an exposed, ground-contacting lower surface. In some cases, however, one or more of these components may be omitted. In one embodiment, sole structure 104 may comprise a sole plate, as will be further discussed below.

Furthermore, in some embodiments, an insole may be disposed in the void defined by upper 102. The insole may extend through each of forefoot region 105, midfoot region 125, and heel region 145, and between lateral side 185 and medial side 165 of article 100. The insole may be formed of a deformable (for example, compressible) material, such as polyurethane foams, or other polymer foam materials. Accordingly, the insole may, by virtue of its compressibility, provide cushioning, and may also conform to the foot in order to provide comfort, support, and stability.

A midsole may be fixedly attached to a lower area of upper 102, for example, through stitching, adhesive bonding, thermal bonding (such as welding), or other techniques, or may be integral with upper 102. A midsole may be formed from any suitable material having the properties described above, according to the activity for which article 100 is intended. In some embodiments, the midsole may include a foamed polymer material, such as polyurethane (PU), ethyl vinyl acetate (EVA), or any other suitable material that operates to attenuate ground reaction forces as sole structure 104 contacts the ground during walking, running, or other ambulatory activities.

Furthermore, a midsole may extend through each of forefoot region 105, midfoot region 125, and heel region 145, and between lateral side 185 and medial side 165 of article 100. In some embodiments, portions of the midsole may be exposed around the periphery of article 100, as shown in FIG. 1. In other embodiments, a midsole may be completely covered by other elements, such as material layers from upper 102. For example, in some embodiments, a midsole and/or other portions of upper 102 may be disposed adjacent to a bootie.

Furthermore, as shown in FIG. 1, article 100 may include a tongue 172, which may be provided near or along a throat opening of upper 102. In some embodiments, tongue 172 may be provided in or near an instep region 110 of article 100. However, in other embodiments, tongue 172 may be disposed along other portions of an article of footwear, or an article may not include a tongue.

In addition, as noted above, in different embodiments, article 100 may include a tensioning system 150. Tensioning system 150 may comprise various components and systems for adjusting the size of opening 130 leading to an interior void and tightening (or loosening) upper 102 around a wearer's foot. In one embodiment, tensioning system 150 comprises a fastening mechanism for the article of footwear. Some examples of different tensioning systems that can be used are disclosed in Beers et al., U.S. Patent Publication Number 2014/0070042 published Mar. 13, 2014, (previously U.S. patent application Ser. No. 14/014,555, filed Aug. 30, 2013) and entitled "Motorized Tensioning System with Sensors" and Beers et al., U.S. Pat. No. 8,056,269, issued Nov. 15, 2011 (previously U.S. Patent Publication Number 2009/0272013, published Nov. 5, 2009) and entitled "Article of Footwear with Lighting System," the entire disclosures of which are incorporated herein by reference.

In different embodiments, there may be different tensioning elements incorporated or used with a tensioning system. For example, in some embodiments, tensioning elements that could be used include, but are not limited to: cables, cords, wires, strings, laces, straps, belts, ribbons, chains as well as any other kinds of tensioning members. In some embodiments, tensioning system 150 may comprise one or more laces, as well as a motorized tensioning device. A lace may be configured to pass through various lacing guides 154, which may be further associated with the edges of the throat opening. In some cases, lacing guides 154 may provide a similar function to traditional eyelets on uppers. In particular, as a lace is pulled or tensioned, the throat opening may generally constrict so that upper 102 is tightened around a foot.

Figure 2:
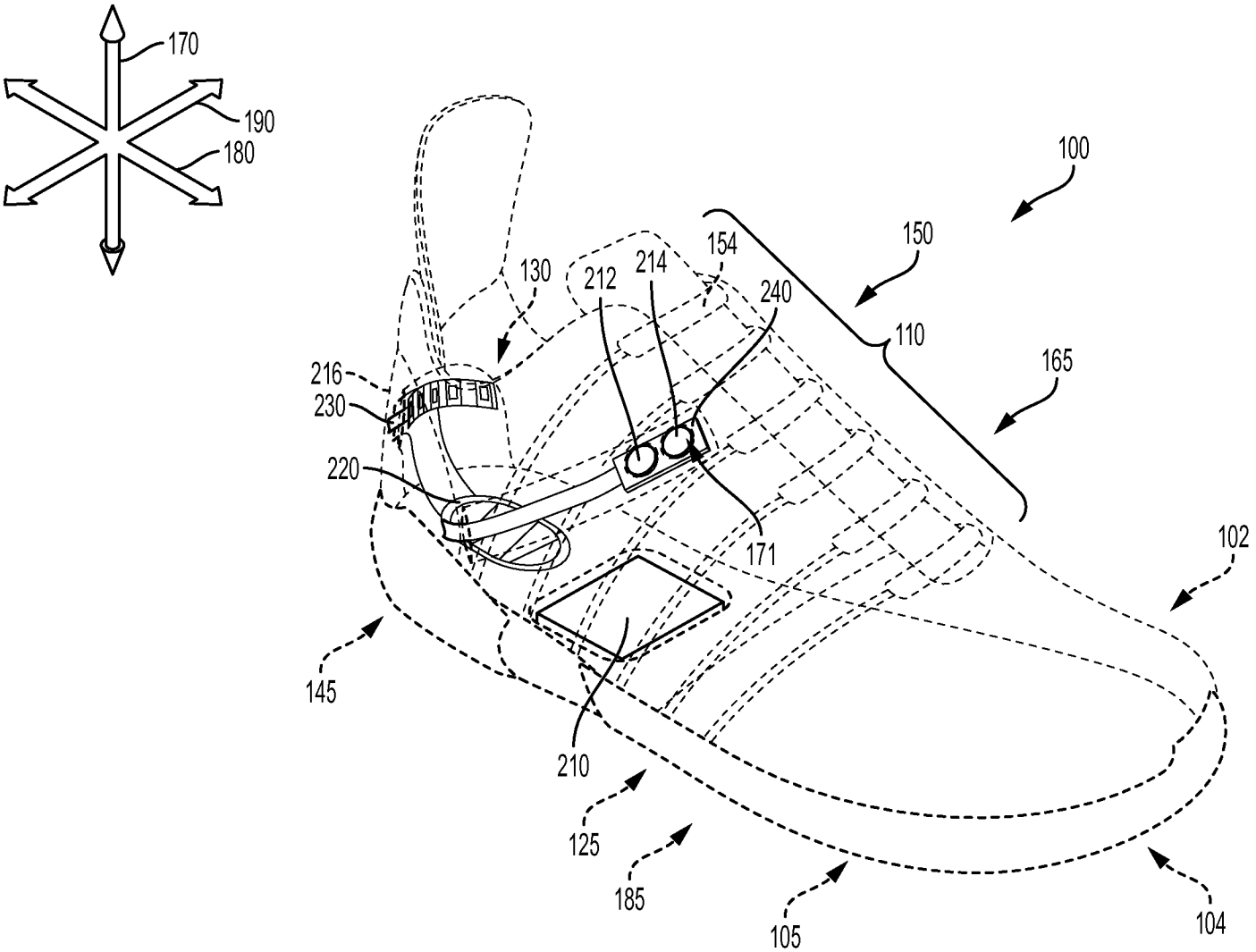
FIG. 2 is a schematic isometric side view of an embodiment of an article of footwear.

The arrangement of lacing guides 154 in FIGS. 1-2 is only intended to be exemplary, and it will be understood that other embodiments are not limited to a particular configuration for lacing guides 154. Furthermore, the particular types of lacing guides 154 illustrated in the embodiments are also exemplary and other embodiments may incorporate any other kinds of lacing guides or similar lacing provisions. In some other embodiments, for example, laces could be inserted through traditional eyelets. Some examples of lace-guiding provisions that may be incorporated into the embodiments are disclosed in Cotterman et al., U.S. Patent Application Publication Number 2012/0000091, published Jan. 5, 2012 and entitled "Lace Guide," the disclosure of which is incorporated herein by reference in its entirety. Additional examples are disclosed in Goodman et al., U.S. Patent Application Publication Number 2011/0266384, published Nov. 3, 2011 and entitled "Reel Based Lacing System," the disclosure of which is incorporated herein by reference in its entirety. Still additional examples of lace guides are disclosed in Kerns et al., U.S. Patent Application Publication Number 2011/0225843, published Sep. 22, 2011 and entitled "Guides For Lacing Systems," the disclosure of which is incorporated herein by reference in its entirety.

A lace as used with article 100 may comprise any type of lacing material known in the art. Examples of laces that may be used include cables or fibers having a low modulus of elasticity as well as a high tensile strength. A lace may comprise a single strand of material or can comprise multiple strands of material. An exemplary material for the lace is SPECTRA™, manufactured by Honeywell of Morris Township N.J., although other kinds of extended chain, high modulus polyethylene fiber materials can also be used as a lace. Still further exemplary properties of a lace can be found in the Reel Based Lacing System Application mentioned above.

Thus, in some embodiments, a lace may be passed through lacing guides 154. In other embodiments, a lace may pass through internal channels within upper 102 after entering one or more channel openings that are disposed near lacing guides 154. In some embodiments, an internal channel can extend around the sides of upper 102 and guide the lace toward a motorized tensioning device disposed in sole structure 104. In some cases, the motorized tensioning device may include provisions for receiving portions of a lace. In some cases, end portions of the lace can exit internal channels of upper 102 and can pass through apertures in a housing unit that contains a motorized tensioning device.

In some embodiments, a motorized tensioning device may generally be configured to automatically apply tension to a lace for purposes of tightening and loosening upper 102. A motorized tensioning device may thus include provisions for winding a lace onto, and unwinding a lace from, a spool internal to the motorized tensioning device. Moreover, the provisions may include an electric motor that automatically winds and unwinds the spool in response to various inputs or controls.

Thus, in different embodiments, an article may include provisions for actuating, managing, commanding, directing, activating, or otherwise regulating the functions of other devices or systems. In FIG. 1, while upper 102 and sole structure 104 are depicted in solid line, portions of article 100 were depicted in dotted line to provide the reader with an introductory view of possible components that can comprise tensioning system 150. Referring now to FIG. 2, examples of these components are depicted in solid line. In some embodiments, components can include an electronic control unit ("ECU") 210, a sensor 220, a light panel 230, and/or a manual control device ("control device") 240. In different embodiments, there may be a fewer or a greater number of components. In some embodiments, one component may be substantially similar to another component. However, in other embodiments, each component may be different from another component.

In one embodiment, one or more of the components may be configured to provide various functions or features to article 100. For example, different mechanical or electrical components may be included, such as circuitry, textiles, or other materials. It should be understood that while two or more components may be connected or attached to one another, or share a common port, in other embodiments, any two components could be separate or disconnected from one another. In addition, article 100 may be manufactured to accommodate one or more of the components in a manner that allows ready and secure incorporation of the components post manufacture. In other words, article 100 may include one or more compartments for receiving any components.

In different embodiments, ECU 210 may include various mechanisms or components that can be utilized in tensioning system 150. In some cases, ECU 210 may comprise a housing unit with a motorized tensioning device. For example, within the interior of ECU 210 there may be a battery (or other power source), circuitry (or other control mechanism), spools, gears, a motor, light sources, and/or other mechanisms.

In different embodiments, control of a motorized lacing system or other electrical or automated features in an article can be accomplished using various processes and apparatuses. Some embodiments may utilize various kinds of devices for sending commands to a motorized tensioning system or other systems associated with article 100. For example, some embodiments can incorporate a variety of sensors for providing information to a control unit of a motorized tensioning system. In some embodiments, a sensor may provide a current as an input to a control unit. In some cases, for example, a predetermined current may be known to correspond to a certain pressure or weight. In one embodiment, pressure sensors could be used under the insoles of an article to indicate when the user is standing. In another embodiment, a motorized tensioning system can be programmed to automatically loosen the tension of the lace when the user moves from the standing position to a sitting position. Such configurations may be useful for older adults that may require low tension when sitting to promote blood circulation but high tension for safety when standing, for example. In other embodiments, various features of a motorized tensioning system may turn on or off, or adjust the tension of a lace, in response to information from a sensor. In other embodiments, sensors may be used to provide information that can determine the activation of LED or other light sources. However, in other embodiments, it will be understood that the use of any sensor may be optional.

In different embodiments, the sensors providing information might include, but are not limited to, pressure sensors in an insole to detect standing and/or rate of motion, bend indicators, strain gauges, gyroscopes, and accelerometers. In some embodiments, an article of footwear can include weight sensors, light sensors, audio sensors, or heat sensors. In some embodiments, instead of or in addition to maintaining an initial tension, the sensor information may be used to establish a new target tension. For example, pressure sensors could be used to measure contact pressures of the upper of an article of footwear against the foot of a wearer and automatically adjust to achieve a desired pressure.

In some embodiments, sensors such as gyroscopes and accelerometers could be incorporated into article 100. In some embodiments, an accelerometer and/or gyroscope could be used to detect sudden movement and/or position information that may be used as feedback for adjusting lace tension, for example. These sensors could also be implemented to control periods of sleep/awake to extend battery life. In some cases, for example, information from these sensors could be used to reduce lacing tension in a system when the user is inactive, and increase lacing tension during periods of greater activity.

It is also contemplated that some embodiments could incorporate pressure sensors to detect high-pressure regions that may develop during tightening. In some cases, the tension of the lace could be automatically reduced to avoid such high-pressure regions. Additionally, in some cases, a system could prompt a user to alter the lacing arrangement associated with these high-pressure regions.

It is further contemplated that in some embodiments a user could be provided with feedback through motor pulsing, which generates haptic feedback for the user in the form of vibrations/sounds. Such provisions could facilitate operation of a tensioning system directly, or provide haptic feedback for other systems in communication with a motorized tensioning device.

Various methods of automatically operating a motorized tensioning device in response to various inputs can be used. For example, after initially tightening a shoe, it is possible for the lace tension to decline in the first few minutes of use. Some embodiments of a tensioning system may include provisions for readjusting lace tension to the initial tension set by the user. In some embodiments, a control unit may be configured to monitor tension in those first minutes to then readjust tension to match the initial tension.

In some embodiments, the sensor may include various mechanisms or components that can be utilized for measuring current, pressure, or other properties in article 100. Referring to FIGS. 1-2, sensor 220 comprises a force sensitive resistor (FSR) disposed in heel region 145 within sole structure 104. In different embodiments, sensor 220 may detect and measure a relative change in a force or applied load, detect and measure the rate of change in force, identify force thresholds, and/or detect contact and/or touch. In some cases, the sensor may comprise a generally two-dimensional material. In some embodiments, sensor 220 may include a piezoelectric material. However, in other embodiments, sensor 220 may comprise any desired object or element for insertion into article 100. Sensor 220 may have different dimensions and/or shapes in different embodiments and be disposed in other regions or portions of article 100. In some embodiments, the application of pressure (for example, of a foot being inserted into article 100) can activate sensor 220, which in turn can trigger other events.

Furthermore, in some embodiments, light panel 230 can comprise a light-emitting diode strip (referred to herein as an LED unit). In some embodiments, the LED unit may include various mechanisms or components that can be utilized in tensioning system 150. In some cases, the LED unit may include one or more LEDs of varying sizes, colors, and/or intensity levels. For example, light panel 230 includes five LEDs. However, in other embodiments, light panel 230 may comprise any desired object or element for insertion into article 100. The LED unit may have different dimensions and/or shapes in different embodiments. In FIGS. 1-2, the LEDs are disposed along a substantially continuous, rectangular-shaped and relatively narrow strip.

As noted above with respect to sensor 220 above, some embodiments of article 100 may utilize various kinds of devices for sending or transmitting commands to a motorized tensioning system. In some embodiments, article 100 may utilize control device 240 for sending manually operated commands to a motorized tensioning device or other mechanisms that can be associated with the motorized tensioning device. In some embodiments, buttons for tightening, loosening, and/or performing other functions can be located directly on or in an article on a control device. For purposes of this disclosure, buttons refer to a material or element that can be pressed or otherwise handled, such as a button, switch, knob, control, lever, handle, or other such control means. In some embodiments, the control device may include various buttons, switches, mechanisms, or components that can be used to operate a mechanism. In some embodiments, buttons can be utilized to measure current, pressure, or other properties in article 100. In different embodiments, the control device may include components or elements that can detect and measure a relative change in a force or applied load, detect and measure the rate of change in force, identify force thresholds, and/or detect contact and/or touch.

Referring to FIGS. 1-2, in some cases, control device 240 may include one or more buttons 171 disposed along a button board or panel. In one specific embodiment, buttons 171 could be used for initiating incremental tightening and incremental loosening commands, for example. In other embodiments, additional buttons can be included for initiating any other commands. In one embodiment, in order to interact with the control device and the features of tensioning system 150, a user may contact and/or exert a force against a portion of control device 240, such as buttons 171, as will be described further below with respect to FIGS. 5 and 7-11.

In FIG. 2, control device 240 includes a first button 212, and a second button 214. In some embodiments, first button 212 may represent or correspond to a "plus" button, and second button 214 may represent or correspond to a "minus" button. However, in other embodiments, control device 240 may comprise any number of buttons. The button board that holds or accommodates buttons 171 of control device 240 may further have different dimensions and/or shapes in different embodiments. In FIGS. 1 and 2, buttons 171 are disposed along a substantially continuous, rectangular-shaped and relatively narrow strip.

Thus, in different embodiments, when a user engages with control device 240, a variety of different operations may be activated or discontinued. For purposes of reference, throughout the detailed description and in the claims, various operating modes or configurations of a tensioning system are described. These operating modes may refer to states of the tensioning system itself, as well as to the operating modes of individual subsystems and/or components of the tensioning system.

It should be understood that, in other embodiments, any of the components could be disposed in any other portions of an article, including the upper and/or sole structure. In some cases, some components could be disposed in one portion of an article and other components could be disposed in another, different, portion. In another embodiment, for example, ECU 210 could be disposed near the heel of article 100, while control device 240 could be disposed near forefoot region 105 of article 100. The location of one or more components may be selected according to various factors including, but not limited to, size constraints, manufacturing constraints, aesthetic preferences, optimal design and functional placement, ease of removability or accessibility relative to other portions of article 100, as well as possibly other factors.

Furthermore, in some embodiments, as a result of the integration of various components within article 100, it can be possible for two or more components to work in concert or conjunction with one another. For example, in one embodiment, when pressure is exerted on sensor 220, a signal may be transmitted to activate the LED unit of light panel 230. Thus, during insertion of a foot, when a heel applies pressure in article 100 (stepping downward), the LED lights of light panel 230 can turn on, and/or after the heel has been lifted, the LED lights can turn off, or vice versa. Furthermore, some regions of article 100 may be configured for providing optimal use of various components. In one example, one or more regions of article 100 such as a heel counter 216 may include light-diffusive, light-transmissive, translucent, or transparent materials, to facilitate the transmission of light from an LED. Referring to FIG. 2, heel counter 216 may be formed of a light-diffusive material, for example. Thus, light panel 230 comprising an LED unit may emit light that can be visible to the wearer or others via the diffuse material of heel counter 216. In some embodiments, an enhanced aesthetic design may be produced by the use of various materials with the LED unit. In another example, components can interact with a tensioning device to activate or operate tensioning system 150.

Figure 3:
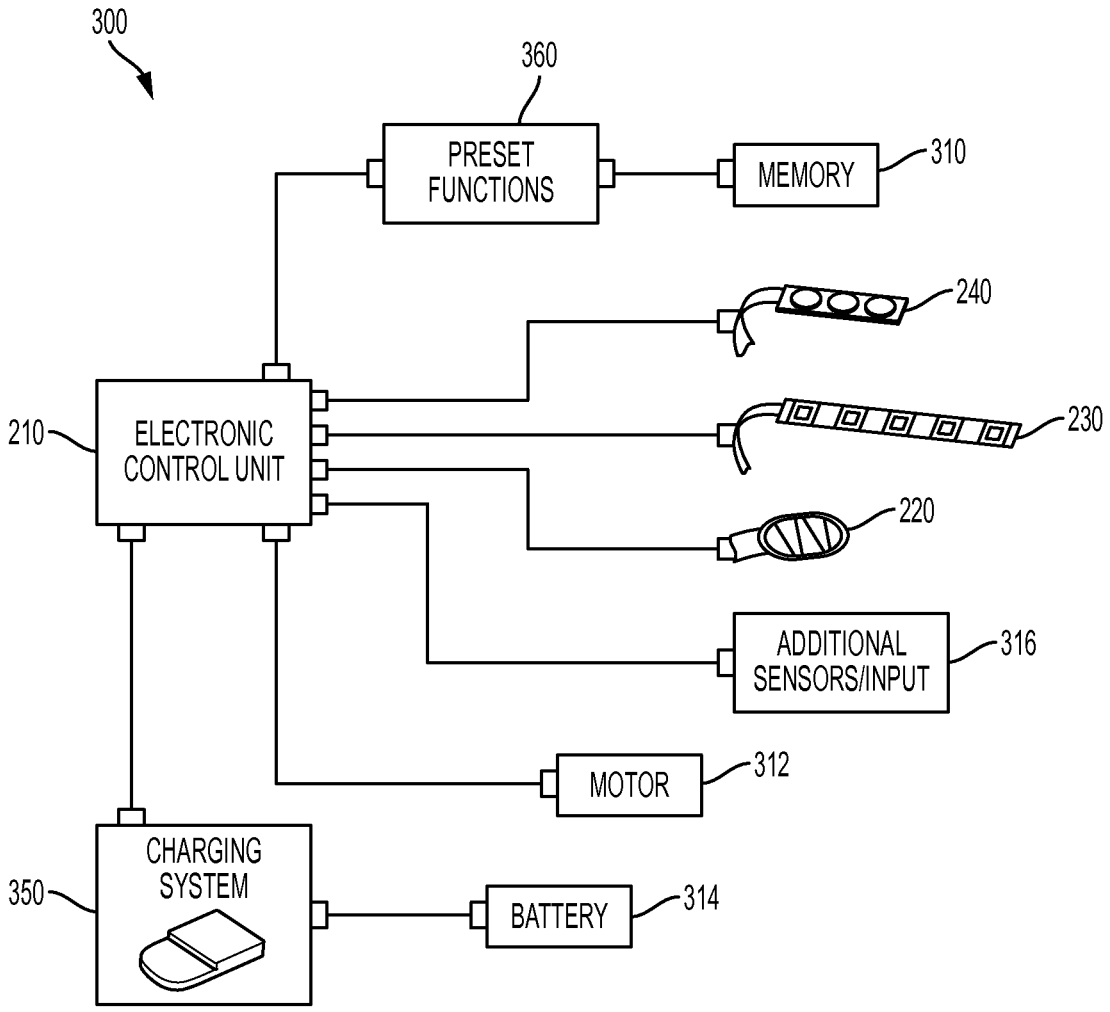
FIG. 3 is a flowchart representing an embodiment of components of a tensioning system.

In different embodiments, the present disclosure and its associated components (described above) can further comprise an automated tensioning system 300, as shown schematically in FIG. 3. For purposes of this disclosure, an automated tensioning system helps to manage the various processes of the footwear tensioning system, including the software, hardware, and/or memory, and can provide the user with an interface to run and use applications. In some cases, automated tensioning system 300 can accept input and display output, by communicating with hardware, and interacting with any respective applications or system software that might be using that hardware. Automated tensioning system 300 may work directly in conjunction with one or more hardware devices (for example, an integrated circuit disposed in ECU 210) and computer instructions and data that reside as software on that device. In some cases, automated tensioning system 300 may connect to and manage multiple components and functions of the article of footwear, as depicted in FIG. 3.

In FIG. 3, for purposes of illustration, a flow diagram of some of the functions of automated tensioning system (also referred to herein as "system") 300 are shown. In some embodiments, automated tensioning system 300 can help perform basic tasks in the tensioning system, such as recognizing user input from control device 240, sending output to light panel 230, keeping track of files and directories in a memory 310, and controlling one or more devices (such as a motor 312). In some embodiments, automated tensioning system 300 can manage and/or assess the status of any of the components or devices associated with ECU 210, including motor 312, a battery 314, any additional components (such as sensors or other input) 316, memory 310, and other components. In addition, a charging system 350 associated with battery 314 may be managed at least in part by or communicate with automated tensioning system 300 in different embodiments. In one embodiment, there may be various preset functions 360 available in the automated tensioning system that can be utilized through automated tensioning system 300. In another example, automated tensioning system 300 can receive information from sensor 220, as well as engage or disengage the sensor. Furthermore, there may be additional components 316 that can be managed by automated tensioning system 300, such as those discussed above with respect to FIGS. 1 and 2.

In one embodiment, the tensioning system can have multiple commands or programs running at the same time, and automated tensioning system 300 can determine which applications should be executed or run in a particular order. Furthermore, the automated tensioning system may determine how much time should be permitted to each application before running the next application. One example will be discussed below with respect to the illuminated animations of FIG. 22. In some embodiments, the automated tensioning system can send messages to each application or to the user (in this case, the person wearing the article of footwear) regarding the status of the system, and which operation or application is currently running. Thus, automated tensioning system 300 can provide a platform from which one or more components of the automated tensioning system can be run, managed, utilized, accessed, and/or assessed or diagnosed.

In different embodiments, during use of the tensioning system, there may be one or more conditions or "states" associated with automated tensioning system 300. For purposes of this disclosure, a state represents the operating status, processing stage, or condition of automated tensioning system 300. Generally, automated tensioning system 300 will remain in a first state until a specific event causes automated tensioning system 300 to go to a different, second state. Various events, conditions, actions, and animations may accompany the transitions from one state to another. Throughout the description and the claims, an "event" will refer to a process that triggers or leads to a change from one state to another state.

With regard to the tensioning system described herein, there can be multiple states that are associated with a variety of operations. For purposes of convenience, the various states will be described as corresponding to one of three categories: normal operation, low battery, and charging. Each category and its corresponding states will be discussed separately here. However, it should be understood that these categories are for descriptive purposes only, and a state may correspond to or occur in multiple categories, as well as in categories not identified here. Thus, the separation of each state into a category is for convenience only and should not be understood to limit the application of that state.

Figure 4:
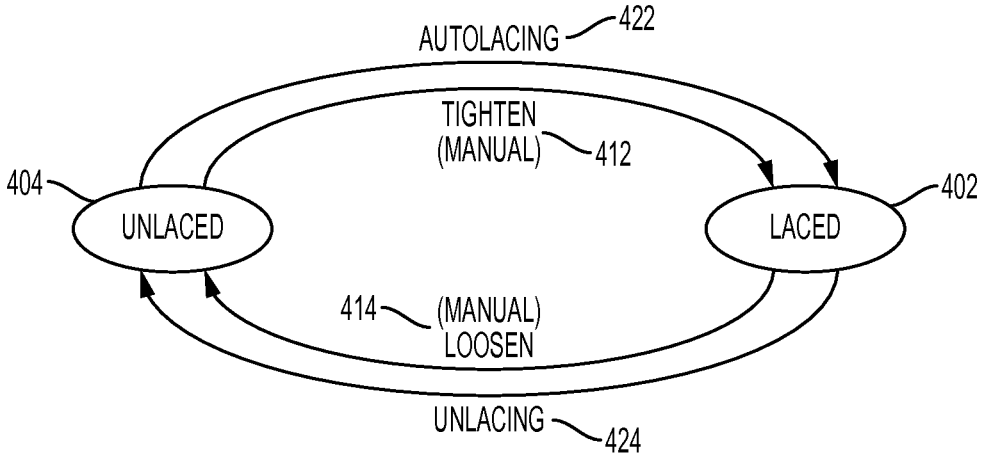
FIG. 4 is a flowchart representing an embodiment of some operation states for a tensioning system.

Referring now to FIG. 4, a diagram representing an embodiment of some of the states associated with normal operations is illustrated. In some embodiments, there may be one or more states that are more sustained or long term than other states. Sustained states for purposes of this disclosure are the states that the article of footwear and its system may generally be associated with during the majority of normal functioning. In one embodiment, there are two sustained states, including a laced state 402 and a fully unlaced state ("unlaced state") 404. In terms of the tensioning system, unlaced state 404 represents a specific condition in which the system recognizes that the article of footwear is fully unlaced (as loose as the system is configured to allow). Furthermore, laced state 402 can represent a specific condition in which the system recognizes that the article of footwear is fully laced (as tightly as the system has been configured to allow) in some embodiments. However, in some cases, laced state 402 may also represent a specific condition in which the system recognizes that the article of footwear is laced to a particular level of tension or tightness that is desired by the user. In other words, laced state 402 need not represent the "fully laced" condition of the article of footwear, and may also be associated with only a minimal amount of tension of the lacing system. In some embodiments, laced state 402 can comprise all levels of tension associated with the laces that are greater than the fully unlaced state (unlaced state 404).

In some embodiments, laced state 402 and/or unlaced state 404 can be determined by a limit switch that is located within the article of footwear. In different embodiments, the limit switch may be a mechanism or sensor that can detect different conditions. In some embodiments, the limit switch may comprise an upper limit switch and/or a lower limit switch. In one embodiment, the limit switch may comprise a dual beam optical sensor. In cases where the limit switch is a dual beam optical sensor, there may be a "flag" or component disposed near the middle of the optical sensor that moves in relation to the state of the system. The flag may be configured to move through a slot formed in the optical sensor. In some embodiments, there can be a screw or other component designed to rotate when the tensioning system operates (i.e., when the lace is winding or unwinding). In some cases, the flag may be attached to or joined to the screw.

Thus, in one embodiment, the movement of the flag may be determined by the screw. For example, when the screw rotates counterclockwise (which can correspond to a tightening of the laces of the tensioning system in some embodiments), the rotation of the screw also moves the flag closer to a first beam of the dual beams of the optical sensor. In one embodiment, the flag may move in a manner that blocks, interrupts, or breaks one of the beams. In some cases, the flag may break the first beam when the tensioning system is in the fully laced state 402. On the other hand, when the tensioning system is loosening, the screw may rotate in a clockwise direction, and the flag can also move in the opposite direction. In some embodiments, when requested by a user or when another specific event occurs for example, the tensioning system can shift to a condition where one of the dual beams is no longer broken. In a similar fashion, when the screw rotates clockwise (which can correspond to a loosening of the laces of the tensioning system in some embodiments), the rotation of the screw also moves the flag closer to a second beam of the dual beams of the optical sensor. In one embodiment, the flag may again move in a manner that blocks, interrupts, or breaks one of the beams. In some cases, the flag may break the second beam when the tensioning system is in the fully unlaced state 404, signaling that the maximum allowable lace travel has been reached. It should be understood that in other embodiments, the direction of travel of the screw (clockwise, counterclockwise, etc.) may be associated with either tightening or loosening. Furthermore, in different embodiments, another sensor or device may be used to indicate the condition of the tensioning system.

Thus, in one embodiment, unlaced state 404 is a state that occurs when the lower limit switch has been engaged as described above, and the article is at the loosest available tensioning condition. Similarly, in one embodiment, laced state 402 is a state that occurs when the upper limit switch has been engaged as described above, and the article is at the tightest available tensioning condition. However, in other embodiments, another type of sensor or switch may be used to identify the different laced or unlaced states.

As well as sustained states, during normal operation there may be one or more transitory states that the article of footwear and its system may be associated with when transitioning between the two sustained states. As noted previously, one feature of the tensioning system disclosed herein is its ability to provide automated fastening to the article. For purposes of this disclosure, an automated feature or activity is one that can occur without a continuous command or repeated interaction by a user throughout the duration of the automated activity. For example, the articles incorporating the tensioning system described herein may be able to auto-lace or auto-loosen without sustained or repeated manual adjustment or manual control by the user.

In one embodiment, there can be at least four transitory states, including a tighten state 412, a loosen state 414, an autolacing state 422, and an unlacing state 424. In other embodiments, there may be optional or additional states, including, for example, a tighten preset state, a loosen preset state, a prepare preset state, a measure tighten preset state, and/or a measure loosen preset state, which will be discussed further below.

In terms of the tensioning system, tighten state 412 and autolacing state 422 represent specific conditions in which the system recognizes that the article of footwear is being tightened. In one embodiment, tightening occurs when the motor moves in a forward direction. With respect to tighten state 412, the tightening is occurring as a result of manual input by a user, while autolacing state 422 represents tightening that occurs as a result of automated processes of the system. Furthermore, loosen state 414 and unlacing state 424 represent specific conditions in which the system recognizes that the article of footwear is being loosened. In one embodiment, loosening occurs when the motor moves in a reverse direction (opposite to forward). With respect to loosen state 414, the loosening is occurring as a result of manual input by a user, while unlacing state 424 represents loosening that occurs as a result of automated processes of the system.

In different embodiments, a motor can perform by rotating an object or component associated with the motor. Thus, in one embodiment, a motor is a device that can convert electricity or electrical energy into motion or mechanical torque. In some embodiments, a turning movement of a wheel in the motor occurs during operation of the motor. In one embodiment, there may be a component such as a rotor and/or a shaft which are configured to rotate in the motor. In some cases, when a current is applied to the motor, the current can be converted to mechanical energy or a rotational movement of a component in the motor.

For purposes of this disclosure, references made to a motor moving in a particular direction (for example, in a forward direction or in a reverse direction) refer to the direction of turning or rotation of the rotating component associated with the motor. For example, in one embodiment, the forward direction may refer to the clockwise rotational direction of a rotor in the motor. In another embodiment, the forward direction can refer to the counter-clockwise rotational direction of a rotor in the motor. Thus, it should be understood that the directional terms are not intended to define precise operations of the motor. Rather, references to a direction are intended to represent general rotational movement of a component of the motor. Furthermore, the forward direction and the reverse direction should be understood to represent opposing rotational directions.

Figure 5:
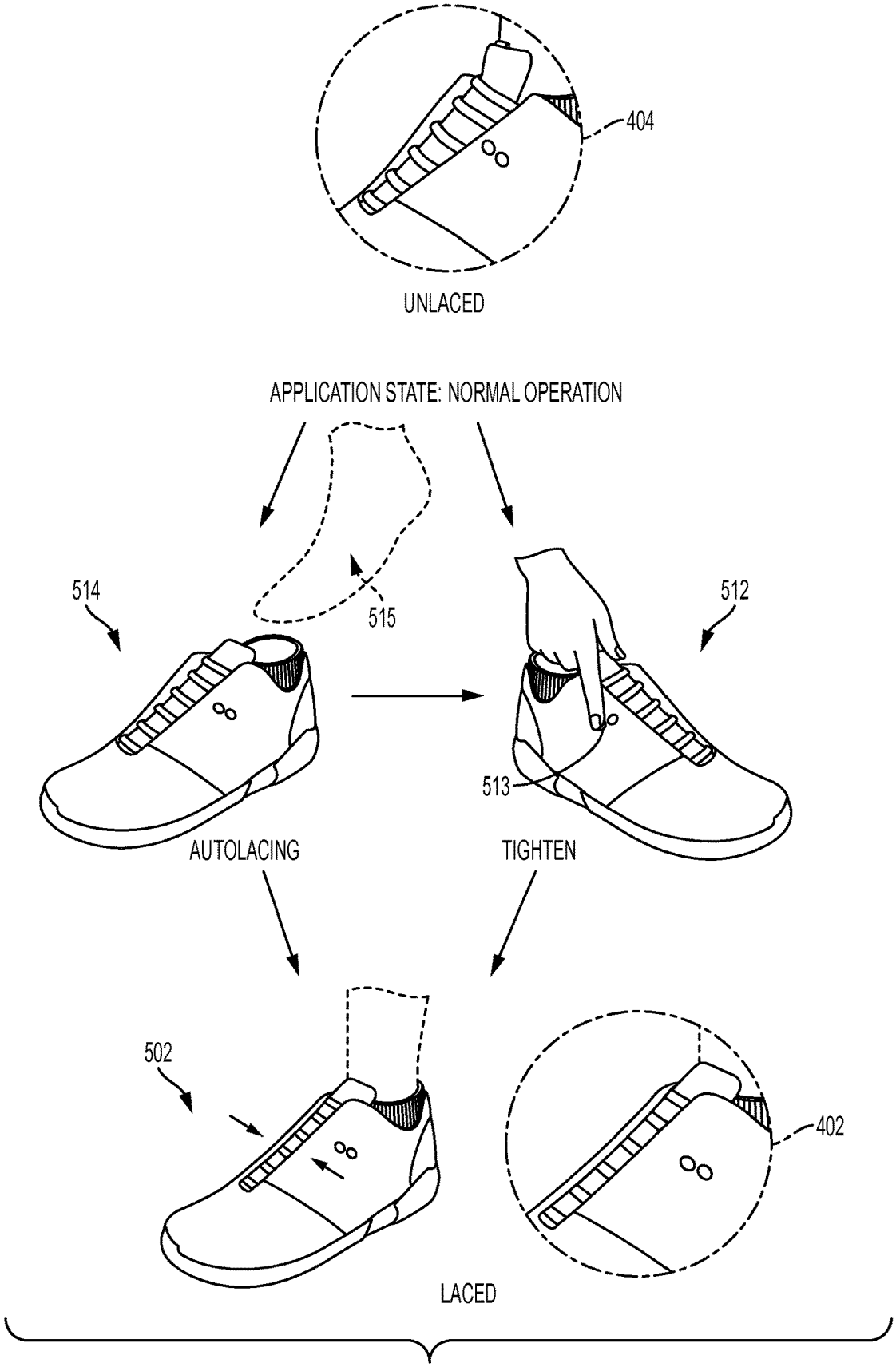
FIG. 5 is a schematic flowchart representing an embodiment of some operations of a tensioning system.

In order to provide the reader with a better understanding of the embodiments, FIG. 5 provides a graphical illustration of some of the normal operating lacing states for an article of footwear. In different embodiments, during normal operation, lacing or tightening of an article may be triggered by different events. In one case, a user may interact with the system using a manual control device, such as the first button or the second button (see FIG. 2) to initiate a transition from unlaced state 404 to a different state. Pressing a tighten or "plus" button 513 may, for example, be registered by the system and initiate a corresponding tightening command in the system and cause the motor to move forward, as shown in a first article 512. "Plus" button 513 may be associated with either the first button or the second button in different embodiments. This event may trigger the tighten state (as described in FIG. 4). In one embodiment, the article may transition to laced state 402, as shown in a third article 502. In another case, the heel sensor (such as the FSR) may be engaged when a foot 515 is inserted into the article and an input to the sensor is registered, as shown with a second article 514. This event may trigger the autolacing state, as described with respect to FIG. 4. In some embodiments, the system will remain in autolacing state 422 or tighten state 412 (as described with respect to FIG. 4) until a specific condition or event occurs, as represented in part by FIG. 6 below. In one embodiment, the article may transition to laced state 402, as shown in third article 502.

Figure 6:
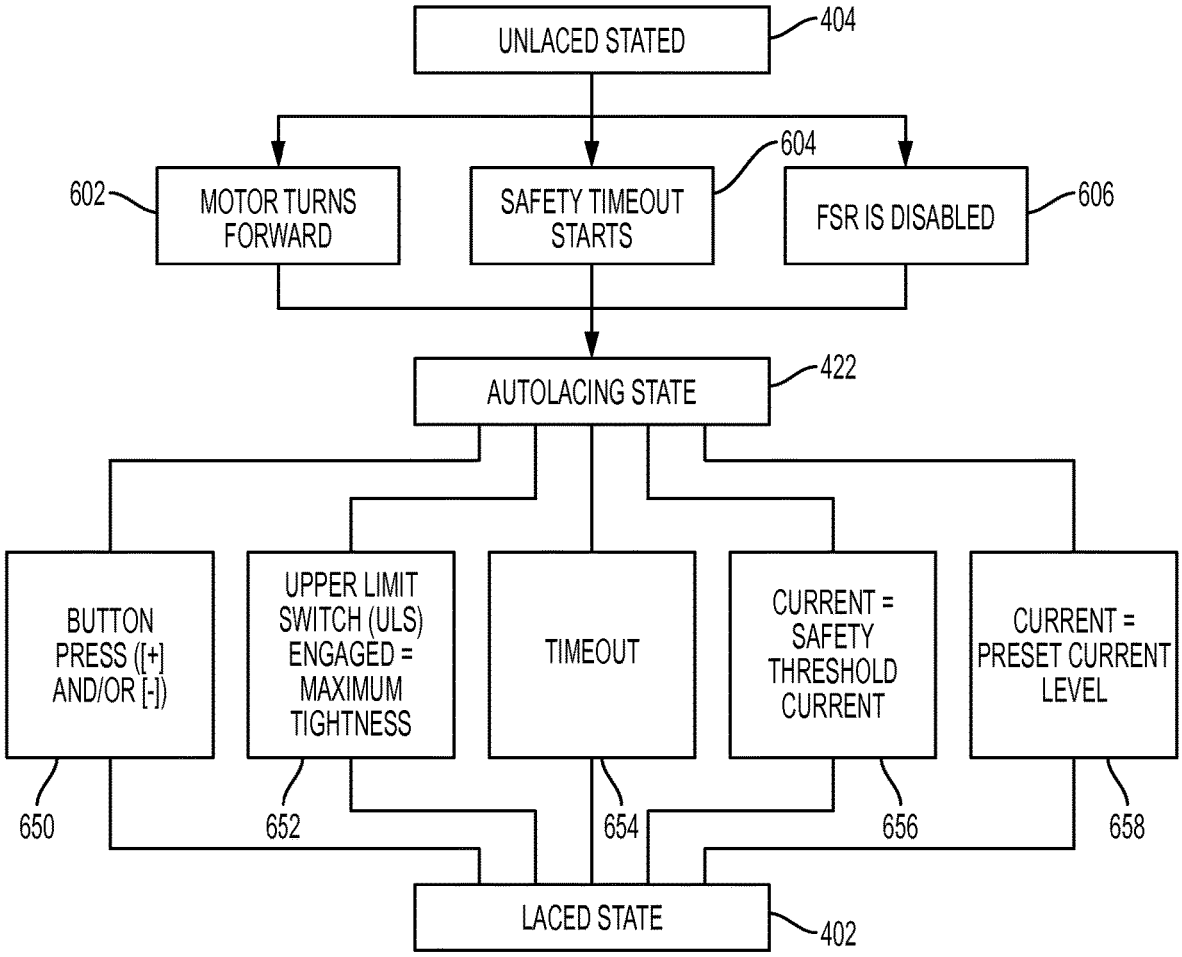
FIG. 6 is a flowchart representing an embodiment of some operations of a tensioning system.

Referring to the schematic chart of FIG. 6, it can be seen that in some embodiments, several events can accompany the transition from unlaced state 404 to autolacing state 422. In other words, when the transition to autolacing state 422 is triggered, one or more processes may occur or be triggered in the automated tensioning system as well. In some embodiments, there may be three or more distinct processes or events that occur. One process may include the movement of the motor in a forward direction to provide tightening of the laces ("motor turns forward" 602), as discussed above. Another process or event may comprise the start of the safety timer countdown ("safety timeout starts" 604), which will be discussed further below. A third possible event is the disabling of the heel sensor or FSR ("FSR is disabled" 606), discussed earlier with respect to FIGS. 1-2. In other embodiments, there may be fewer or more events, and the events may differ from those described here.

Furthermore, it can be seen that in some embodiments, several events can initiate the transition from autolacing state 422 to laced state 402. In other words, there may be one or more events that can trigger the transition to laced state 402. In some embodiments, there may be at least five events that can indicate to the system that autolacing state 422 is complete and/or that a shift to laced state 402 may occur. As listed in the flowchart of FIG. 6, these events may include activation of the manual controls ("button press ([+] and/or [−])" 650), the engagement of the upper limit switch as discussed above ("upper limit switch (ULS) engaged=maximum tightness" 652), notification of a safety timeout ("timeout" 654), and/or the determination that the current level is approximately equal to or greater than a preset safety current level ("current=safety threshold current" 656), which will be discussed below. Another event may be a determination that the current level is approximately equal to or greater than a saved preset current level ("current=preset current level" 658), which will be discussed with respect to FIGS. 14-20 below. In other embodiments, there may be fewer or more of these events, and the events may differ from those described here.

Thus, in some embodiments, if a button (such as first button 212 or second button 214 shown in FIGS. 1 and 2) is pressed during autolacing state 422, the system will discontinue the autolacing process, and the motor will cease tensioning activity. In addition, in some embodiments, if the safety timeout occurs (see below), and/or the upper limit switch engages (e.g., a beam has been interrupted, as discussed above), the system can stop the autolacing process and shift to laced state 402. Furthermore, the system can transition from autolacing state 422 to laced state 402 if it determines that the motor current, as measured at the motor, has reached a saved preset level, as will be discussed further below.

As mentioned earlier, in some embodiments, the automated tensioning system may further include a safety timer function or safety timeout utility. For purposes of this disclosure, a safety timer is a countdown timer application or timer function that is designed to pause, shut off, or otherwise discontinue operation of the motor upon registration of the timeout by the system. In some cases, it may provide a kind of safeguard that can override other input to the system. This can ensure the article tightness remains below a specified limit in some embodiments. For example, in an article without a limit switch, or an article in which the limit switch is deactivated, the safety timeout can maintain a restriction on the maximum duration of tightening permitted by the system. In some embodiments, the safety timer may be preset to have a duration of 8 seconds before the timeout. In other embodiments, the duration of the safety timeout may be less than or greater than 8 seconds, including between 1 second and 7 seconds, or 9 seconds and 15 seconds. In some cases, the safety timer can be triggered by different events such as user interaction with a manual control button, as will be discussed further below.

Figure 7:
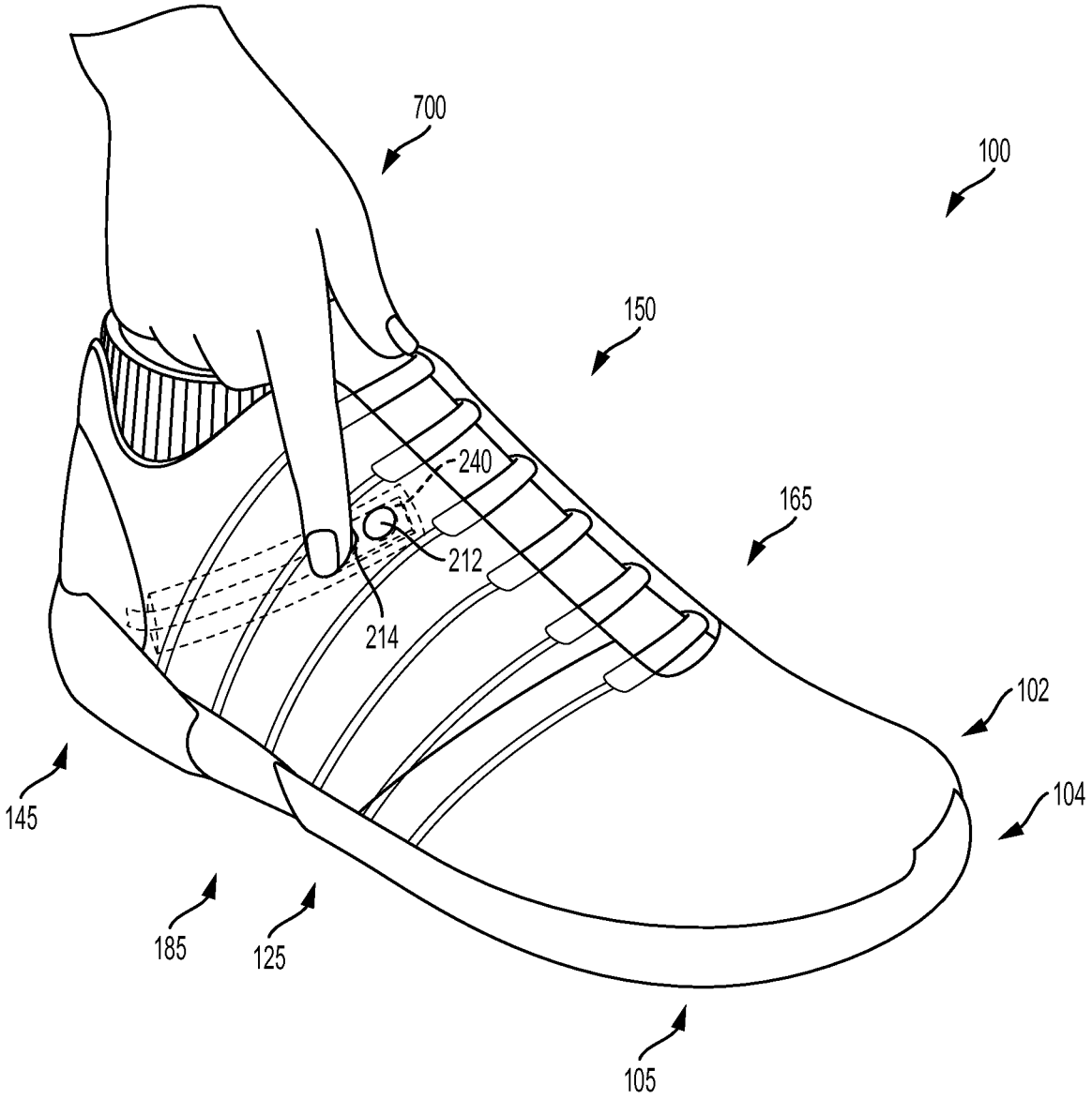
FIG. 7 is a schematic isometric side view of an embodiment of an article of footwear.

As noted with respect to FIGS. 4-5, article 100 may also be tightened and/or transitioned from unlaced state 404 to laced state 402 through various manual controls (i.e., tighten state 412). In FIGS. 7-10, a series of illustrations depict one embodiment of the manual control experience. Manual control, for purpose of this disclosure, refers to the operation of any feature of the tensioning system that occurs as a result of an intentional user interaction with the manual controls. In different embodiments, the type of manual control(s) available, and the functions offered through the interaction with the manual controls, can vary. In one example, as noted above, manual controls comprise one or more buttons disposed somewhere along the article. In some embodiments, the manual controls comprise a control device disposed along the article of footwear. In FIG. 7, upper 102 and sole structure 104 of article 100 are depicted in solid line, while control device 240 is depicted in dotted lines. Control device 240 may be installed within a compartment in some cases. In one embodiment, control device 240 is located along the instep region (as shown in FIGS. 1 and 2). However, it should be understood that in other embodiments, control device 240 may be located or installed in any other region of article 100.

A user (represented here by a hand) 700 may be able to utilize control device 240 to interact, engage, operate, and/or activate various functions of article 100. In some embodiments, functions can include different aspects of tensioning system 150, as described with respect to FIG. 2. In order to interact with control device 240, user 700 may contact and/or exert a force against a portion of the control device. In the embodiment of FIG. 7, an index finger of user 700 is being used to apply pressure to second button 214 (i.e., second button 214 is being depressed), which is adjacent to first button 212.

Figure 8:
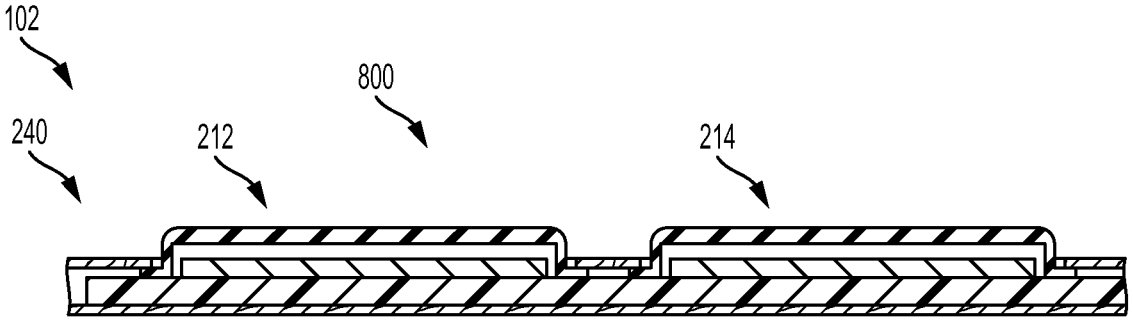
FIG. 8 is a cross-sectional illustration of an embodiment of manual controls.
Figure 9:
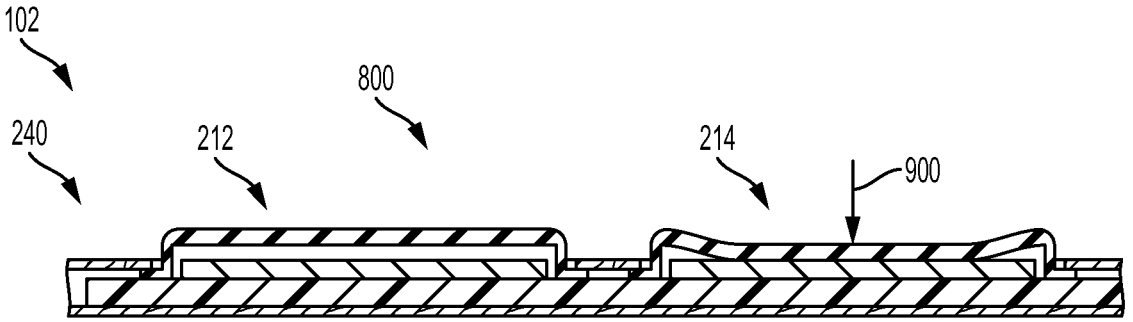
FIG. 9 is a cross-sectional illustration of an embodiment of the activation of manual controls.
Figure 10:
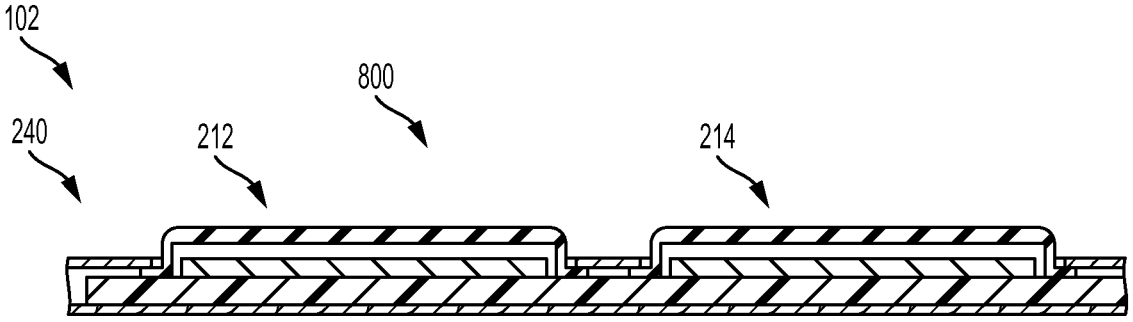
FIG. 10 is a cross-sectional illustration of an embodiment of manual controls.

In FIG. 8, a side-view cross section of an embodiment of a portion of control device 240 as installed in upper 102 is depicted, including two buttons 800 (here, first button 212 and second button 214). In FIG. 8, control device 240 is in a rest or neutral state. Referring now to FIG. 9, as a force 900 is applied to the covering over second button 214, contact may occur between the cover and second button 214, which can elicit a signal or otherwise produce a change within control device 240 or other systems. Thus, control device 240 may enter an activated state. In some embodiments, buttons 800 can be used by a person to interact with control device 240 and the systems associated with control device 240. In order to discontinue the use of manual control, the user may cease application of pressure on second button 214, as shown in FIG. 10, where control device 240 is again restored to a neutral or rest state. In some embodiments, the manually activated tightening or loosening process described here, once begun, may also be interrupted or discontinued by depressing an adjacent button (e.g., first button 212), such that both first button 212 and second button 214 are being pressed simultaneously. It should be understood that these processes may be applicable to first button 212, second button 214, and any other buttons that are included in article 100 in different embodiments.

In some embodiments, when a user engages with a control device, a variety of different operations may be activated or disabled. Referring again to FIGS. 7-10, in some embodiments, user 700 may use control device 240 to initiate one or more other or additional control commands. Some examples of control commands may include, but are not limited to, left/right shoe selection, incremental tighten, incremental loosen, open/fully loosen, store or save preset command, and recall/restore preset command. For example, in one embodiment, first button 212 and second button 214 can be used to select the article of footwear (i.e., left or right) that will receive and respond to the control commands. In some embodiments, either first button 212 or second button 214 may be selected, but both may not be selected simultaneously. In other cases, it may be possible to select or activate both first button 212 and second button 214 simultaneously, to allow a user to tighten, loosen, open both articles simultaneously, or initiate some other function. In another example, a third button may be included that can be used for initiating an "incremental tighten" command of tensioning system 150.

Furthermore, in different embodiments, an incremental loosening or tightening of article 100 can occur in discrete steps so that each time the wearer presses a button (for example, first button 212), the lace can be "let out" up by a predetermined amount (for example by rotating a spool within a motorized tensioning device). In other cases, an incremental loosening can occur in a continuous manner, as long as the wearer continues to touch first button 212. In some cases, the speed of loosening can be set so that the system does not overshoot a preferred level of tightness (i.e., the system doesn't move between too tight and not tight enough too quickly) while also being large enough to avoid overly long times for fully loosening article 100. With this arrangement, a user can continue increasing and decreasing the tension throughout article 100 (using the incremental tighten and incremental loosen modes of the manual controls) until a preferred level of tightness for upper 102 is achieved. Thus, tensioning system 150 may provide an option for bypassing the automated systems described herein and allowing the user to manually adjust the lace tension. In other words, one or more buttons or other manual control activations may be used to transition article 100 from the unlaced state to the laced state.

With respect to FIGS. 7-10, it should be understood that the safety timeout function described above may also be applicable to manual control usage in different embodiments. Thus, in some embodiments, if user 700 depresses first button 212, tensioning system 150 will begin to tighten. In one embodiment, tensioning will cease for at least a few seconds after the safety timeout occurs, regardless of ongoing or additional user interaction with the manual controls. Furthermore, in some embodiments, the upper limit switch (discussed above) may be associated with the manual controls, such that the tightening operation will cease if the upper limit switch is engaged. In other embodiments, if the system determines that the current level is approximately equal to or greater than a preset safety current level, the automated tensioning system will cease tightening.

Figure 11:
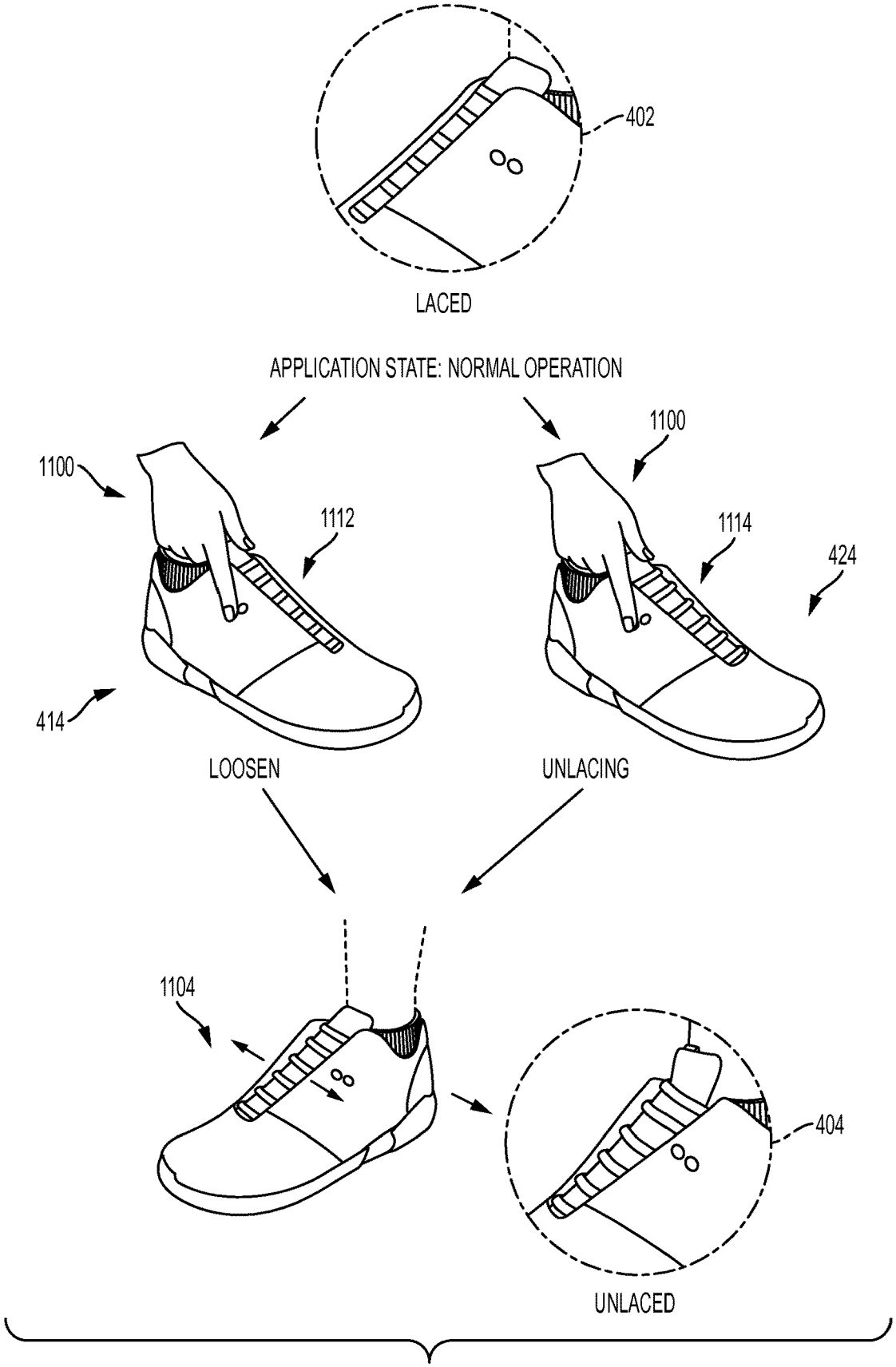
FIG. 11 is a schematic flowchart representing an embodiment of some operations of a tensioning system.

Once an article is in the laced state on a user's foot, the user may engage in different activities. In some embodiments, depending on the article's configuration, a user shown may participate in all the activities that would normally be associated with an athletic or any other type of article of footwear. However, the user may desire to loosen and/or remove an article after use, or during a rest period. In order to provide the reader with a better understanding of the embodiments, FIG. 11 provides a graphical illustration of two of the normal operating loosening states for an article of footwear. In different embodiments, during normal operation, unlacing or loosening of an article may be triggered by different events. In one case, a user 1100 (represented here by a hand) may interact with the system using a manual control device, such as the first button or the second button, disposed on a first article 1112 or second article 1114. The "minus" button may be associated with either the first button or the second button in different embodiments. Pressing the loosen or "minus" button may, for example, initiate a corresponding loosening command in the system and cause the motor to reverse in some embodiments. This event may trigger loosen state 414, as shown with respect to first article 1112. In another case, user 1100 may maintain pressure on a button for longer than a predetermined length of time. This event may trigger (automated) unlacing state 424 in some embodiments, as shown with respect to second article 1114. In some embodiments, holding the "minus" button for longer than 2 seconds may initiate unlacing state 424. In other embodiments, the duration may be shorter or longer than 2 seconds. In one embodiment, holding the button for longer than 3 seconds may trigger unlacing state 424.

In one embodiment, the article may include provisions to decrease the probability of an inadvertent triggering of the autolacing process (autolacing state 422) during unlacing. For example, in some embodiments, the commencement of unlacing state 424 may also initiate a disabling of the FSR. In some cases, the FSR may be disabled for a predetermined duration. In one embodiment, the duration may be selected based on the average length of time a user generally requires to remove his or her foot from the article. For example, the FSR may be disabled for 10 seconds in some embodiments. In other embodiments, the FSR may be disabled for less than or greater than 10 seconds.

Referring to FIG. 11, in some embodiments, the system will remain in unlacing state 424, or loosen state 414, until a specific condition or event occurs. In one case, the article may transition to unlaced state 404, as shown with respect to third article 1104. In some other cases, the article can transition back to laced state 402.

For example, if a user has pressed the "minus" button for less than a predetermined period of time (e.g., 2 seconds), the article may loosen briefly and then transition from loosen state 414 back to laced state 402. In another embodiment, if an article is nearly fully unlaced, the brief press (a press for less than a predetermined period of time) of the "minus" button may loosen the tensioning system to the extent that the lower limit switch engages (as described above), and the article is at the loosest available tensioning condition, identified as unlaced state 404. Furthermore, in some embodiments, holding the "minus" button for longer than 2 seconds may initiate unlacing state 424 that can continue until the article is loosened to the maximum extent available by the system, and unlaced state 404 is reached. However, in some embodiments, if a button other than the "minus" button is pressed during unlacing state 424, the system will stop the unlacing process, and the motor will cease loosening activity and return to laced state 402. In other words, in some cases, user 1100 may be able to interrupt either the manual loosen state 414 or the unlacing state 424, by pressing the "plus" button, for example.

Figure 13:
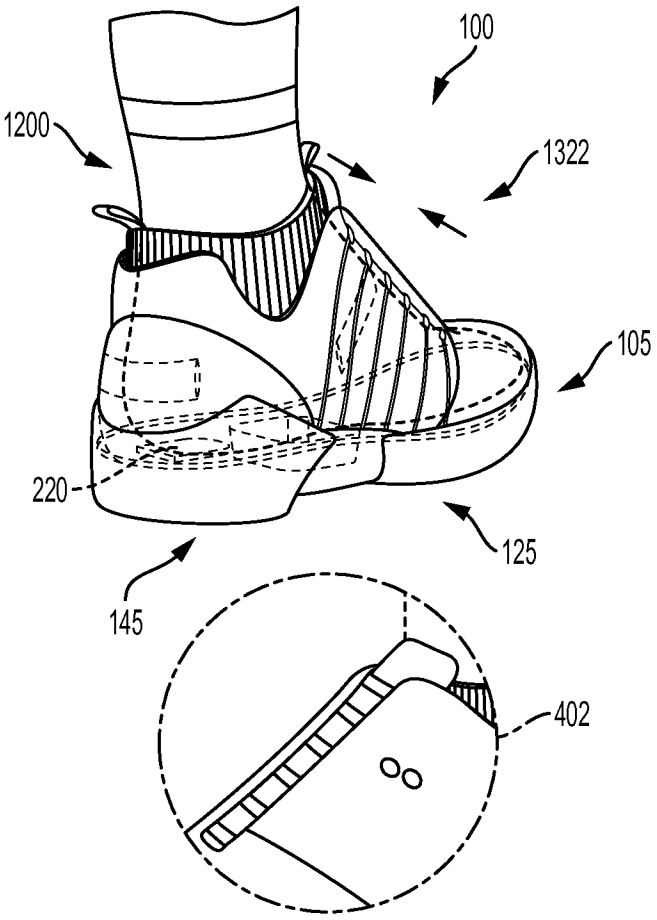
FIG. 13 is a schematic isometric rear view of an embodiment of an article of footwear.
Figure 12:
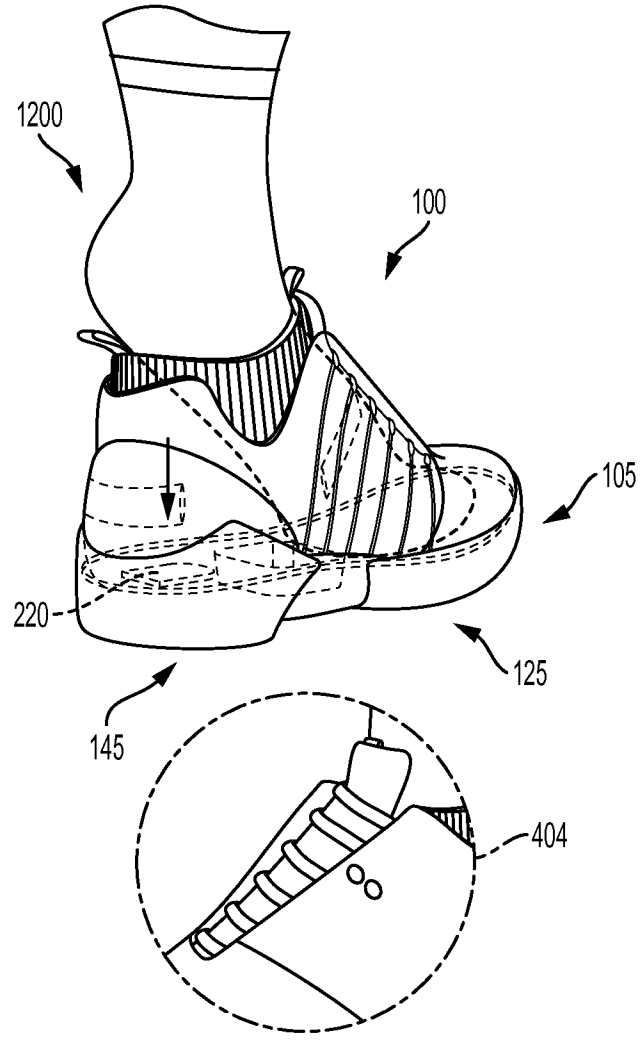
FIG. 12 is a schematic isometric rear view of an embodiment of an article of footwear.

As mentioned above, in some embodiments, different states or functions may be triggered by the activation of a sensor. In some embodiments, an autolacing process (also referred to as autolacing state 422 above) may be initiated by the activation of sensor 220. As described earlier, in some embodiments, a sensor may be disposed in an article of footwear. In one embodiment, the sensor can comprise a force sensitive resistor (FSR). In some cases, as depicted in FIGS. 12 and 13, the FSR (here, sensor 220) may be disposed along heel region 145 of article 100. Referring to FIG. 12, as a user inserts his/her foot 1200 into article 100, the FSR has not yet been engaged or activated. Article 100 is shown in unlaced state 404 (see magnified view). However, as shown in subsequent FIG. 13, when foot 1200 is fully inserted into article 100, such that the heel of foot 1200 can apply pressure along heel region 145, sensor 220 can become engaged in some embodiments. In one embodiment, when sensor 220 detects a predetermined or preset amount of pressure or weight (i.e., a force), sensor 220 may become activated. In some embodiments, the engagement of sensor 220 can initiate a series of events and cause a change in the state of the automated tensioning system. In one embodiment, the activation or engagement of sensor 220 initiates a process whereby article 100 can transition from unlaced state 404 (see FIG. 12) to laced state 402 (shown in the magnified view of FIG. 13). Thus, in some embodiments, the engagement of sensor 220 may inform the system that article 100 is now being used, and that if the engagement occurs during normal operations of the system, an autolacing process 1322 (depicted in FIG. 13 with arrows) of article 100 should commence. In one embodiment, autolacing process 1322 moves the article to laced state 402.

Other transitory states can provide a user with further options regarding the use of the tightening system by measuring the motor current in some embodiments. In different embodiments, the power associated with the motor of the tightening system may be used as a correlation for the amount of tightness of the lace. In some embodiments, the power output or the power that is required by the motor to perform a function can be used as a correlation to the amount of tightness of the tensioning system. In one embodiment, the current being drawn by the motor, or the current used at the motor, can be measured and used to determine the tension level of the article. Thus, in some embodiments, the motor current can be used as a proxy for the amount of tension of the laces. In some cases, information regarding the current level of the motor may be stored or saved as part of the process of saving a particular level of tension (preset level) in the article. In some embodiments, the control device may also include provisions for storing and using preferred tension settings, as will be described in detail below with respect to the save preset command.

The current values associated with the motor during different operations can be used to ascertain the status or functions of the system in some embodiments. For example, when the motor current reaches a certain value, the system may make the determination that the maximum desired lace tightness has been reached. In another embodiment, a user may desire that the laces of the article be tightened to a specific degree or amount. In some embodiments, this level of tightness could be related to a determination that the motor current has reached a certain value. In one embodiment, the automated tensioning system may provide a comfort preset tightness value. The comfort preset can be included in the automated tensioning system as an "out of the box" option in some embodiments. The comfort preset can provide a standard level of lace tightness for the user. In some cases, the comfort preset may be a tightness setting that has been determined to be comfortable to a majority of users during case studies. However, in some cases, a user may desire a preset setting that differs from the comfort preset setting. For example, a user may be an athlete who desires a higher level of tightness when playing a sport. In such cases, the automated tensioning system may allow the user to adjust the preset to a new level using a save preset command.

In some embodiments, a user may use the manual controls (as discussed above with respect to FIGS. 7-10) to initially increase or decrease the amount of tightness of the article. In one embodiment, manual controls may be used to initiate a "store current tension" command and/or a "return to stored tension" command, depending on the duration that the manual controls are activated, for example. Still other embodiments could include provisions for storing multiple tension settings. For example, a user may prefer a tighter fit for playing sports and a looser fit for casual activities. In such cases, a control device may allow a user to store two or more tension settings, corresponding to at least two different lace tension preferences. In different embodiments, storage or recall of tensions for the tensioning system, whether part of a single item or multiple items, such as a pair of shoes, may be performed with a single command issued by a control device or with a series of control commands.

Figure 14:
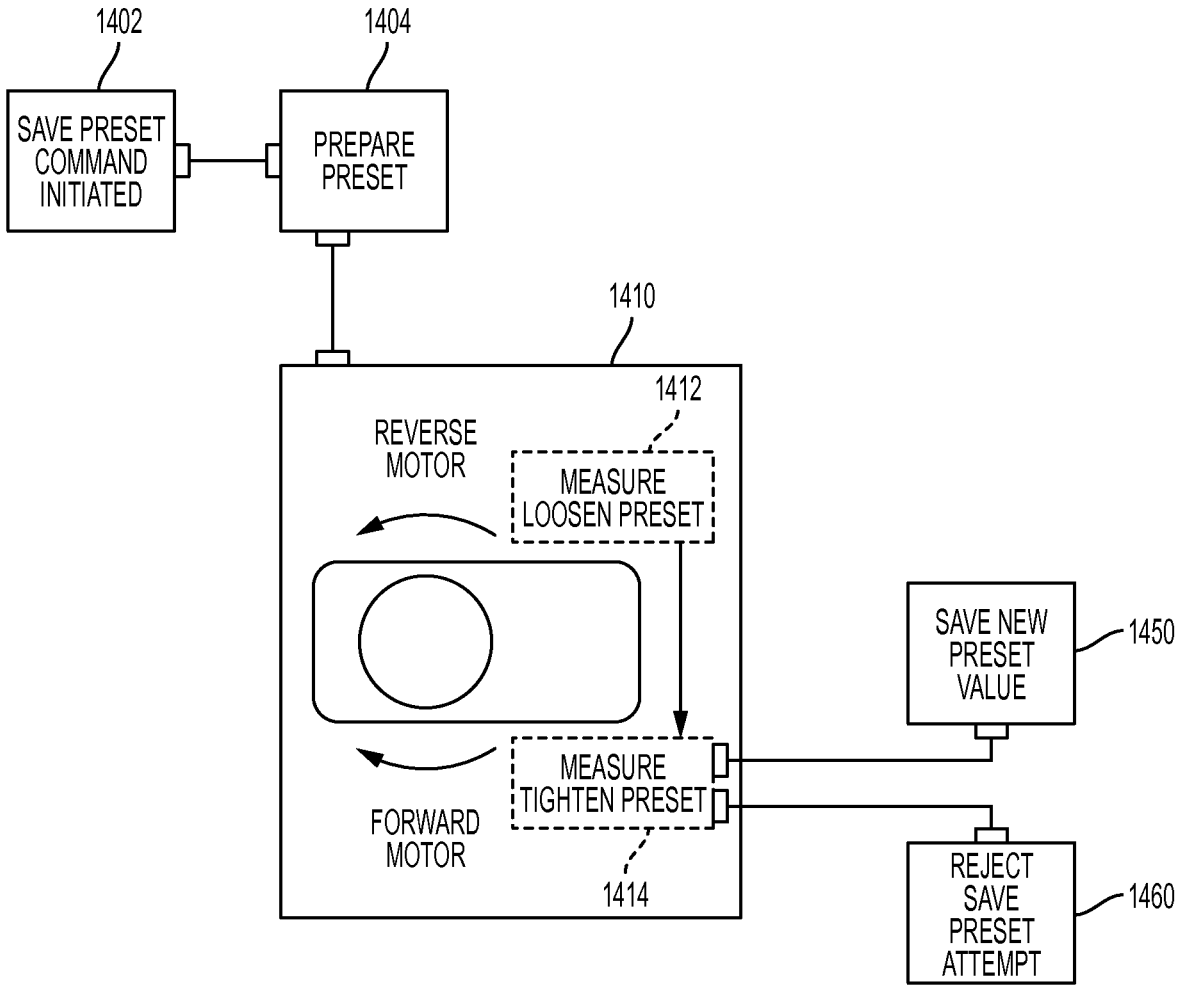
FIG. 14 is a flowchart representing an embodiment of some operations of a tensioning system.

Referring now to the flowchart of FIG. 14, in order to save or store a new preset level, a user can interact with the system to save the motor's current value in memory ("save preset command initiated" step 1402). In some embodiments, one or more of the manual control buttons may be used to initiate a save preset command. In one embodiment, a user can press down both the first button (plus button) and the second button (minus button) and hold both buttons for longer than a predetermined threshold duration. In one embodiment, the predetermined threshold duration may be around 2 seconds. In other embodiments, the minimum duration of depression of buttons may be shorter or greater. Furthermore, in another embodiment, the button or action controlling the preset save function may differ from what is described here. For example, in a different embodiment, only a single button may be required to initiate a save preset command.

Following initiation of the save preset command initiated step 1402, the automated tensioning system may transition from its current state (for example, the laced state or the unlaced state) to a different state. In some embodiments, the system will measure the motor current as it is in the present moment and save this current as the new preset. However, in another embodiment, the save preset command can initiate a specific type of motor activity ("prepare preset" step 1404). For example, in one embodiment, prepare preset step 1404 can lead to a measurement step 1410, in which the motor is prompted to first reverse for approximately 150 milliseconds, and then go forward for approximately 150 milliseconds, before measuring the motor current. During this process, the automated tensioning system may move from a laced state or unlaced state to a measure loosen preset state 1412 (when the motor reverses), followed by a shift to a measure tighten preset state 1414 (when the motor moves forward). In some embodiments, the measurement of motor current can be generally more accurate after the motor has gone in the forward direction for even a relatively brief period of time. In other words, in some embodiments, the measurement of current associated with the operation of the motor can be more accurate when it is determined following a rotation of the motor in the forward direction, prior to any subsequent rotation of the motor in the reverse direction. Furthermore, in some cases, this sequence of "reverse motor-forward motor" can provide the user with auditory, tactile, and/or visual feedback that the save preset command has been accepted and is processing.

In different embodiments, the measurement of current of the motor following a turning or rotation of the motor may occur immediately after the initiation of rotation or a few seconds after the initiation. In some embodiments, the current is measured within a few microseconds to a few seconds of the start of rotation of the motor. In other embodiments, the current can be measured between 0.001 and 10 seconds after the rotation of the motor has initiated. In one embodiment, the current can be measured between 0.1 and 5 seconds following the start of rotation of the motor.

During measure tighten preset state 1414, the automated tensioning system may measure the level of motor current. In some embodiments, there may be a minimum required preset current range that is required by the system to save a preset ("preset minimum"). In one embodiment, the preset minimum may be approximately half an amp (0.5 A). However, in other embodiments, the preset minimum current level may be higher or lower than 0.5 A. Generally, in some embodiments, the preset minimum may represent the approximate current value that has been determined to be the lowest accurately measureable current value by the system. As depicted in FIG. 14, in some embodiments, there may be at least two different paths following the measurement of current. In one embodiment, if the measured motor current is less than the preset minimum, then the attempt to save the new preset may be rejected ("reject save preset attempt" step 1460). However, if the measured motor current is greater than or equal to the preset minimum, the system may proceed with saving a new preset tension value ("save new preset value" step 1450) associated with the measured motor current. Thus, in one embodiment, if measure tighten preset state 1414 determines the motor current is greater than or equal to 0.5 amp, it will proceed to store that current reading as the new preset.

Furthermore, in some embodiments, the automated tensioning system may include provisions for a user to return the article to the saved preset value of tightness. In some embodiments, in order to initiate a return to preset command, the user may interact with the system to adjust the motor current value. In one embodiment, a user can press down both the first button (plus button) and the second button (minus button) and hold the two buttons for less than 2 seconds. In other embodiments, the duration of pressing may be shorter or greater. Furthermore, in another embodiment, the button or action controlling the return to preset function may differ from what is described here. For example, in a different embodiment, only a single button may be required to initiate a return to preset command.

Figure 15:
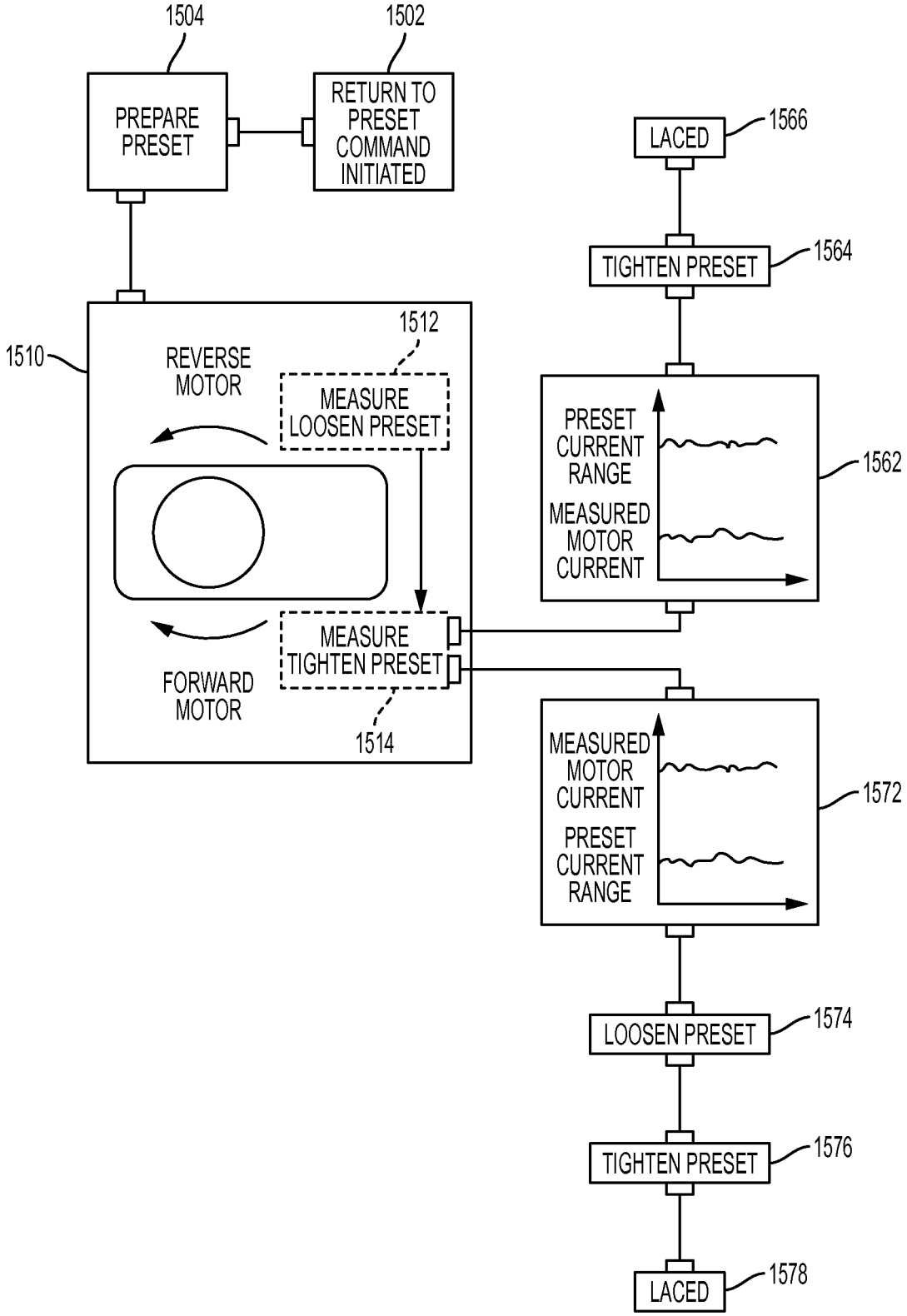
FIG. 15 is a flowchart representing an embodiment of some operations of a tensioning system.

Referring to FIG. 15, in one embodiment, upon initiation of the return to preset command ("return to preset command initiated" step 1502), the automated tensioning system can initiate a specific type of motor activity ("prepare preset" step 1504) in order to assess the present value of the motor current. For example, in one embodiment, prepare preset step 1504 can lead to a measurement step 1510, in which the motor is prompted to first reverse for approximately 150 milliseconds, and then go forward for approximately 150 milliseconds, before measuring the motor current. During this process, the automated tensioning system may move from a laced state or unlaced state to a measure loosen preset state 1512 (when the motor reverses), followed by a shift to a measure tighten preset state 1514 (when the motor moves forward). In some embodiments, the measurement of motor current can be generally more accurate after the motor has gone in the forward direction for even a relatively brief period of time. Furthermore, in some cases, this sequence of "reverse motor-forward motor" can provide the user with auditory, tactile, and/or visual feedback that the save preset command has been accepted and is processing.

The system can then compare the condition of the motor current relative to a preset range of current. For purposes of this disclosure, a preset range is a range associated with the save preset value (as described above). In some embodiments, the preset range is defined as plus or minus 15% of the saved preset value. However, in other embodiments, the preset range may be a larger or smaller range. As depicted in FIG. 15, in some embodiments, there may be at least two different paths following the measurement of current. In one embodiment, if the measured motor current is determined to be greater than the preset range (shown in a step 1572), the system can first loosen ("loosen preset" step 1574) and then tighten ("tighten preset" step 1576). In some embodiments, the tightening may continue until the current approximately matches the saved preset current, or there is either a safety time out or the lower limit is engaged, as will be discussed further below. Once the tightening ceases, the system may enter the laced state ("laced" step 1578).

If, on the other hand, the measured motor current is determined to be less than the preset range (shown in a step 1562), the system can move directly to a "tighten preset" step 1564. In some embodiments, the tightening may continue until the current approximately matches the saved preset current, or there is either a safety time out or the lower limit is engaged, as will be discussed further below. Once the tightening ceases, the system may enter the laced state ("laced" step 1566).

Figure 16:
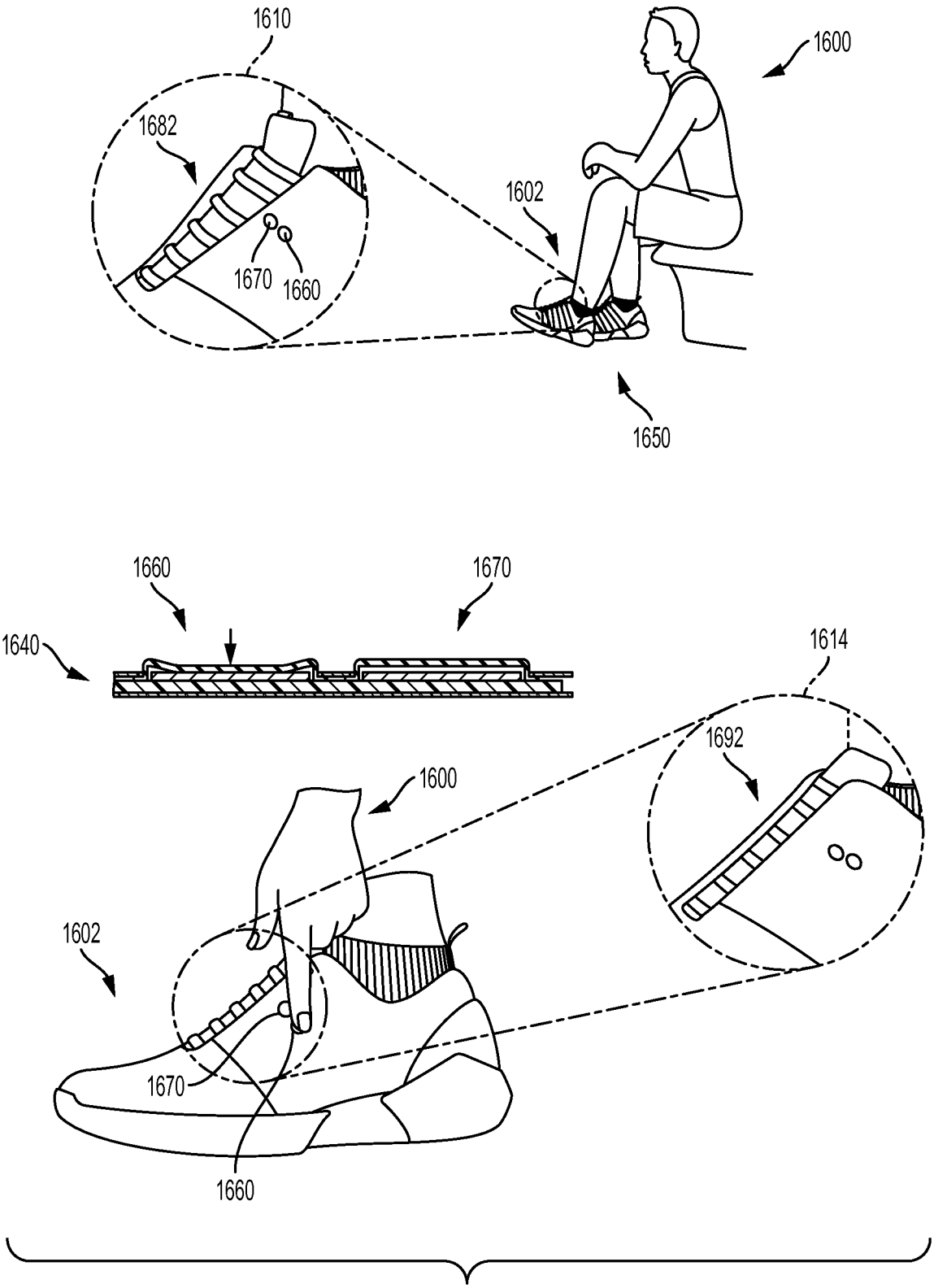
FIG. 16 is a sequence of illustrations representing an embodiment of some operations of a tensioning system.
Figure 17:
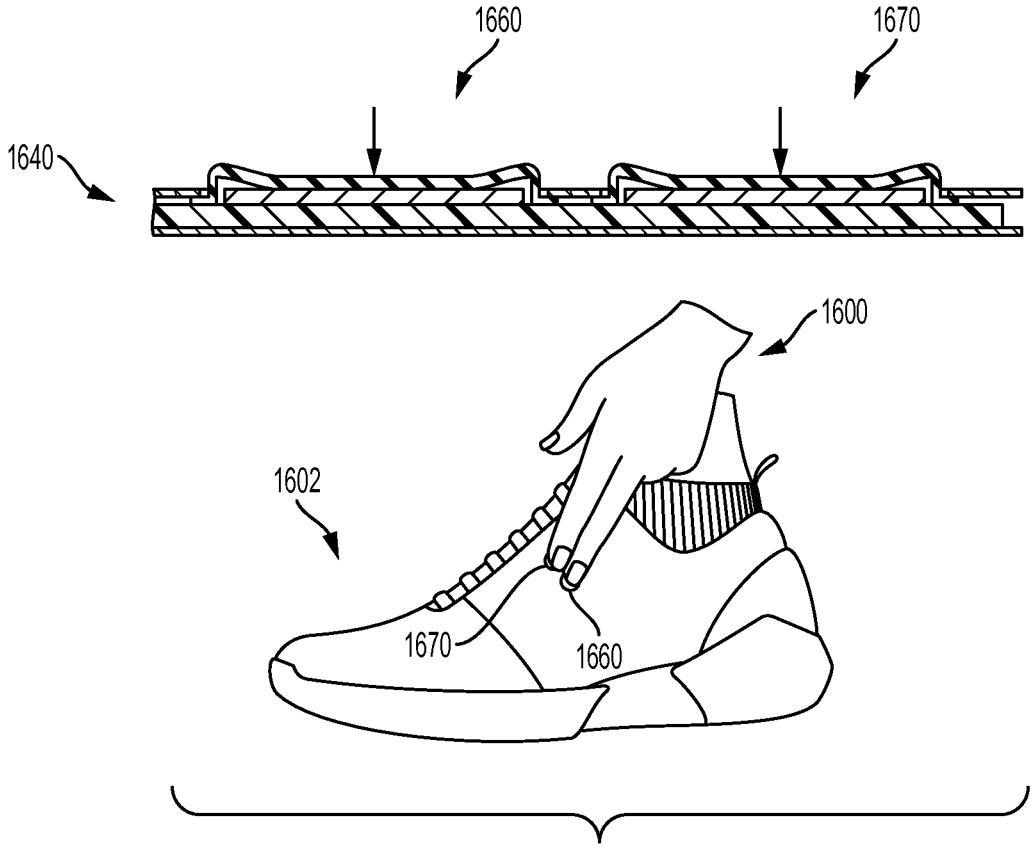
FIG. 17 is an illustration representing an embodiment of some operations of a tensioning system.

Examples of some situations in which the different operations described herein occur may permit the reader with greater understanding of the embodiments. FIGS. 16-19 and 20-22 illustrate two embodiments of possible uses of the tensioning system during athletic events. In FIG. 16, a first player 1600 is shown seated on a bench (for example, during a time-out of a sports match). First player 1600 is wearing articles 1650, where articles 1650 include at least a first article 1602. First magnified view 1610 of first article 1602 is shown in which first article 1602 is associated with a first laced state 1682. Furthermore, a control device 1640 with a first button (a "plus button") 1660 and a second button (a "minus button") 1670 is disposed on a portion of first article 1610.

Prior to reentering the game (for example, during rest or while seated on the bench), first player 1600 may desire an adjustment of the lacing of first article 1602. In one embodiment, as shown in a cross-sectional view of control device 1640 and the magnified view of first article 1602 below, first button 1660 may be depressed by user 1600 for a brief period of time to transition first article 1602 from first laced state 1682 to tighten state 412 (as discussed above with respect to FIG. 4). Upon releasing first button 1660, first article 1602 may be in a second laced state 1692, as depicted in a second magnified view 1614. In some embodiments, second laced state 1692 may comprise a greater tension or tightness of article lacing than first laced state 1682. In other words, first article 1602 may now be more tightly laced on the player's foot than before the interaction with first button 1660.

In some embodiments, first player 1600 may continue in such a manner (i.e., adjusting the tension of first article 1602, which can also include loosening as described earlier) until a more desirable comfort level is achieved. In one embodiment, first player 1600 may wish to add, update, or modify a preset setting or value that can be stored in the memory of the tensioning system of first article 1602. For example, referring now to FIG. 17, first player 1600 may contact and depress both first button 1660 and second button 1670 of control device 1640 for a period of time that is greater than the predetermined threshold duration. As discussed above, some manual control events may allow a user to save a preset tensioning level. In one case, the depression of both buttons for greater than 2 seconds may initiate a "save new tighten preset level" (or the save preset command) operation of first article 1602. As noted earlier, following initiation of the save preset command, the automated tensioning system may transition from a laced state or unlaced state to a different state. As discussed with respect to FIG. 14, in some embodiments, the save preset command can lead to an activation of the motor, where the motor reverses for a short duration and then goes forward for approximately the same duration. The system may then measure the motor current and store the measurement in memory in some embodiments.

Figure 18:
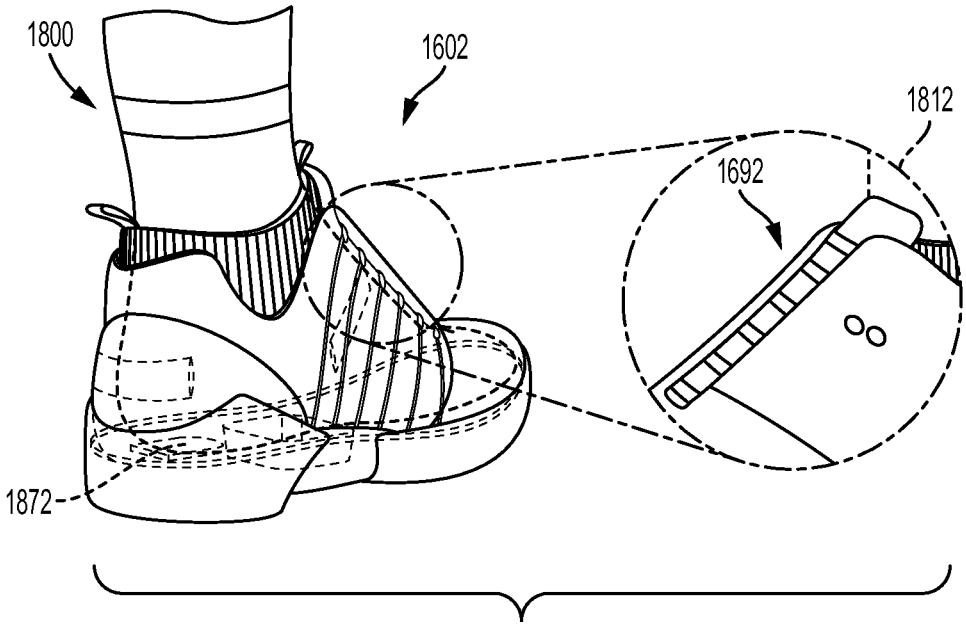
FIG. 18 is an illustration representing an embodiment of some operations of a tensioning system.

Thus, the tensioning system may include provisions to allow first player 1600 to adjust and then save a desired tension setting. In FIG. 18, an illustration of the activation of an FSR 1872 in first article 1602 is shown, as a foot 1800 is inserted into first article 1602 (see FIGS. 12 and 13 for additional information regarding the activation of the heel sensor). In some embodiments, the activation of FSR 1872 can trigger the automatic adjustment of the tensioning level of first article 1602 from an unlaced state to a laced state. In one embodiment, activation of FSR 1872 in first article 1602 may return first article 1602 to the saved tension setting (the preset level), which may be equivalent to second laced state 1692 (stored earlier by the user as shown in FIG. 16). In FIG. 18, the return to second laced state 1692 is depicted in magnified view 1812. In other words, in some embodiments, first player 1600 may use control device 1640 (see FIG. 17) to adjust tension, save a new preset tension level, and also to automatically transition to the preset tension level through the activation of FSR 1872.

Figure 19:
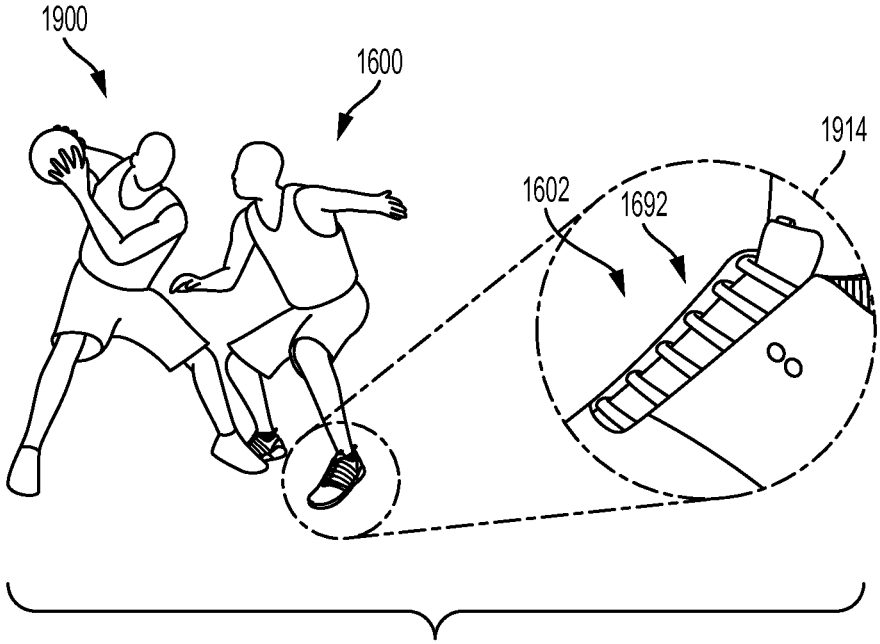
FIG. 19 is an illustration representing an embodiment of some operations of a tensioning system.
Figure 20:
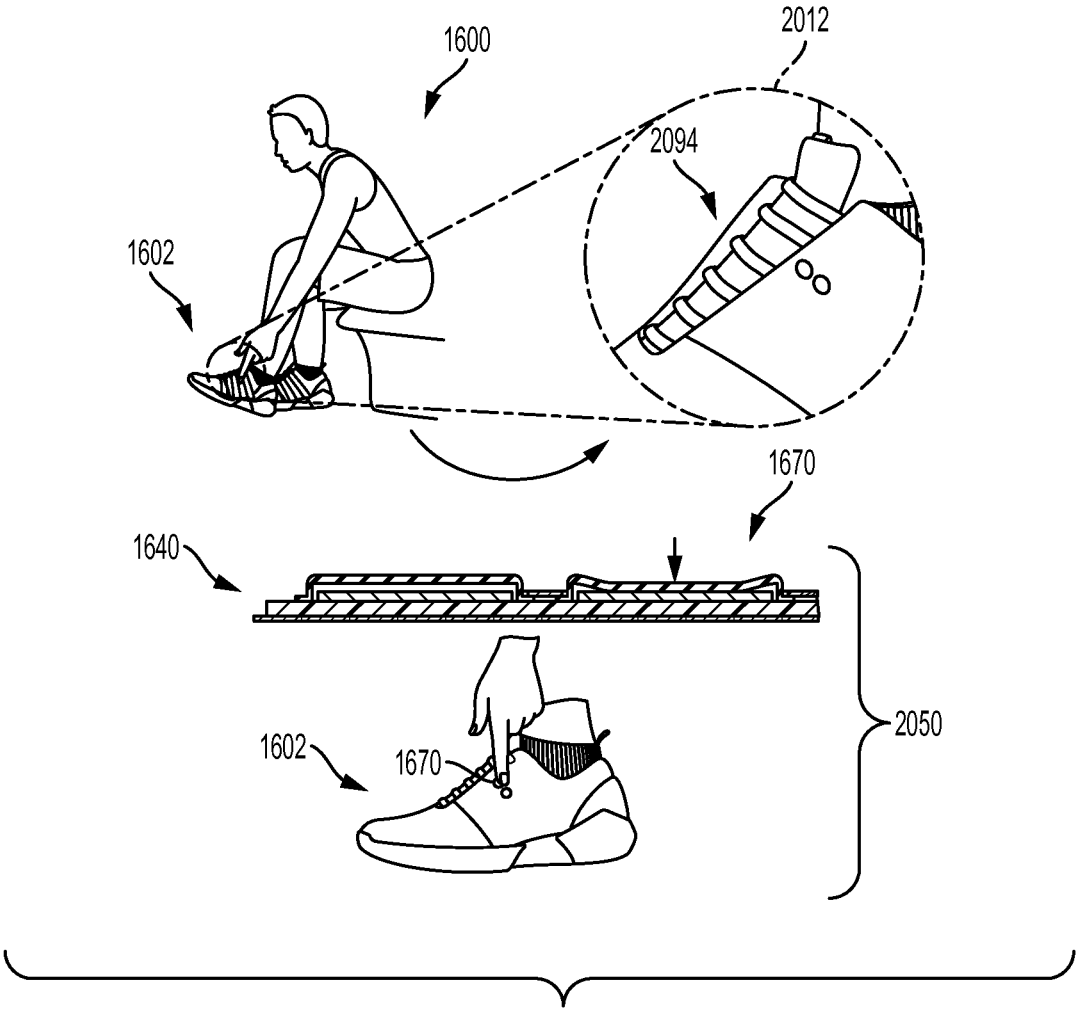
FIG. 20 is a sequence of illustrations representing an embodiment of some operations of a tensioning system.

Referring now to FIG. 19, first player 1600 is shown engaged in an athletic activity with a second player 1900. As shown in a magnified view 1914 of first article 1602, it can be seen that first article 1602 is in second laced state 1692. Following this type (or other type) of athletic activity, first player 1600 can return to a rest state, as depicted in FIG. 20, where first player 1600 is shown seated on a bench. In some embodiments, first player 1600 may desire an adjustment of the lacing of first article 1602 from the tension level associated with second laced state 1692 (see FIG. 19). In one embodiment, as shown below in a sequence 2050, first player 1600 may contact and depress second button 1670 for a brief period of time to transition first article 1602 from laced state 402 to loosen state 414 (as discussed above with respect to FIG. 4). Upon releasing second button 1670, first article 1602 may be in a third laced state 2094, as depicted in a magnified view 2012. In some embodiments, third laced state 2094 may comprise a lesser tension or tightness of article lacing than second laced state 1692. In other words, first article 1602 may now be more loosely laced on the player's foot than it was prior to the interaction with second button 1670. Thus, first player 1600 may enjoy a different tension level while at rest than during the athletic activity if desired.

In some embodiments, following a period of rest, a player may wish to quickly return to the previous tension level in order to rapidly rejoin the athletic activity. As shown in a cross-section view of control device 1640 in FIG. 21, first player 1600 may contact and depress first button 1660 and second button 1670 simultaneously for less than the predetermined threshold duration (see discussion above) in some embodiments. In one embodiment, the predetermined threshold duration may be around 2 seconds. In other embodiments, the maximum duration of the depression of buttons to initiate a "return to preset" function may be shorter or greater. Furthermore, in another embodiment, the button or action controlling the return to preset function may differ from what is described here. For example, in a different embodiment, only a single button may be required to initiate a return to preset command.

Figure 21:
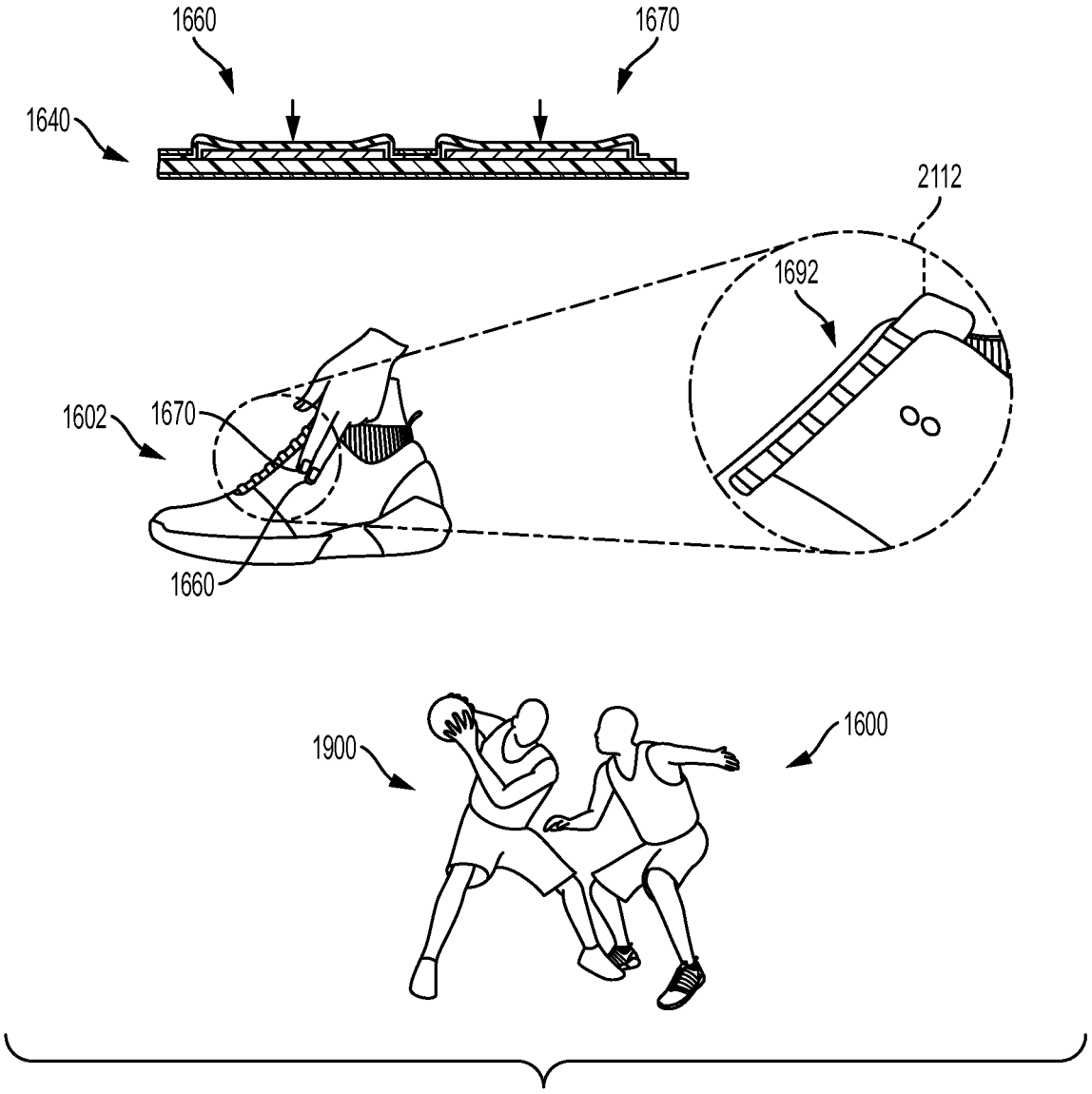
FIG. 21 is a sequence of illustrations representing an embodiment of some operations of a tensioning system.

In one embodiment, the return to preset command initiated manually by first player 1600 in FIG. 21 can transition first article 1602 from the laced state to the tighten state, as discussed above with respect to FIG. 4. Upon releasing first button 1660 and second button 1670, second laced state 1692 may be reinstated in first article 1602, as depicted in a magnified view 2112. In some embodiments, second laced state 1692 may comprise a greater tension or tightness of article than third laced state 2094 of FIG. 20. In other words, first article 1602 may now be again laced on the player's foot with a tension level equivalent to a preferred (preset) tension level, as a result of the preset functions. Thus, first player 1600 may be able to quickly return to a previously stored tension setting for use during athletic activity. This may be beneficial in situations where, for example, a player is summoned into athletic activity with relatively little time to engage in preparatory behavior, and/or the player is notified of the need for readiness to play in an abrupt or sudden manner. As shown in FIG. 21, first player 1600 and second player 1900 have returned to athletic activity, with first article 1602 of first player 1600 returned to second laced state 1692.

For purposes of providing greater clarity to the reader with respect to some of the functions that may be provided by the manual control system, FIG. 22 lists an embodiment of six different manual control events and their corresponding operations. It should be understood that, in different embodiments, there may be additional, fewer, and/or different operations included in the tensioning system than those listed in FIG. 22. Thus, FIG. 22 is only an example of some operations and button commands that may be available to a user.

FIG. 22 includes a first manual event 2210, a second manual event 2220, a third manual event 2230, a fourth manual event 2240, a fifth manual event 2250, and a sixth manual event 2260. First manual event 2210 is associated with a depression of a first button 2202, as shown in the illustration of a first control device 2212 adjacent to the corresponding operation listing. In some cases, the depression of first button 2202 may initiate a tightening of an article of footwear. Second manual event 2220 is associated with the release of first button 2202, shown in the illustration of a second control device 2222 adjacent to the corresponding operation listing. In some cases, the release of first button 2202 may discontinue the tightening of the article of footwear. In addition, third manual event 2230 is associated with a depression of a second button 2204, shown in the illustration of a third control device 2232 adjacent to the corresponding operation listing. In some cases, the depression of second button 2204 may initiate a loosening of an article of footwear. Fourth manual event 2240 is associated with the release of second button 2204, shown in the illustration of a fourth control device 2242 adjacent to the corresponding operation listing. In some cases, the release of second button 2204 may discontinue the loosening of the article of footwear. Furthermore, fifth manual event 2250 is associated with a simultaneous depression of both first button 2202 and second button 2204 for less than 2 seconds, shown in the illustration of a fifth control device 2252 adjacent to the corresponding operation listing. In one case, the depression of both first button 2202 and second button 2204 may initiate a return to the stored preset value of the tensioning system. Sixth manual event 2260 is associated with the depression of both first button 2202 and second button 2204 for at least 2 seconds, shown in the illustration of a sixth control device 2262 adjacent to the corresponding operation listing. In some cases, the depression of both first button 2202 and second button 2204 for at least 2 seconds may initiate storage of a new preset value of the tensioning system in memory. Thus, in some embodiments, a user may interact with the control device in different ways to initiate one or more operations of the tensioning system.

In different embodiments, the motorized tensioning system described herein may include additional features for providing notifications or status information to a user. For example, there may be various types of auditory signals (such as sounds or tones) or a type of tactile feedback (for example, vibration). In another embodiment, there can be visual patterns or programs that are displayed on an article.

Figure 23:
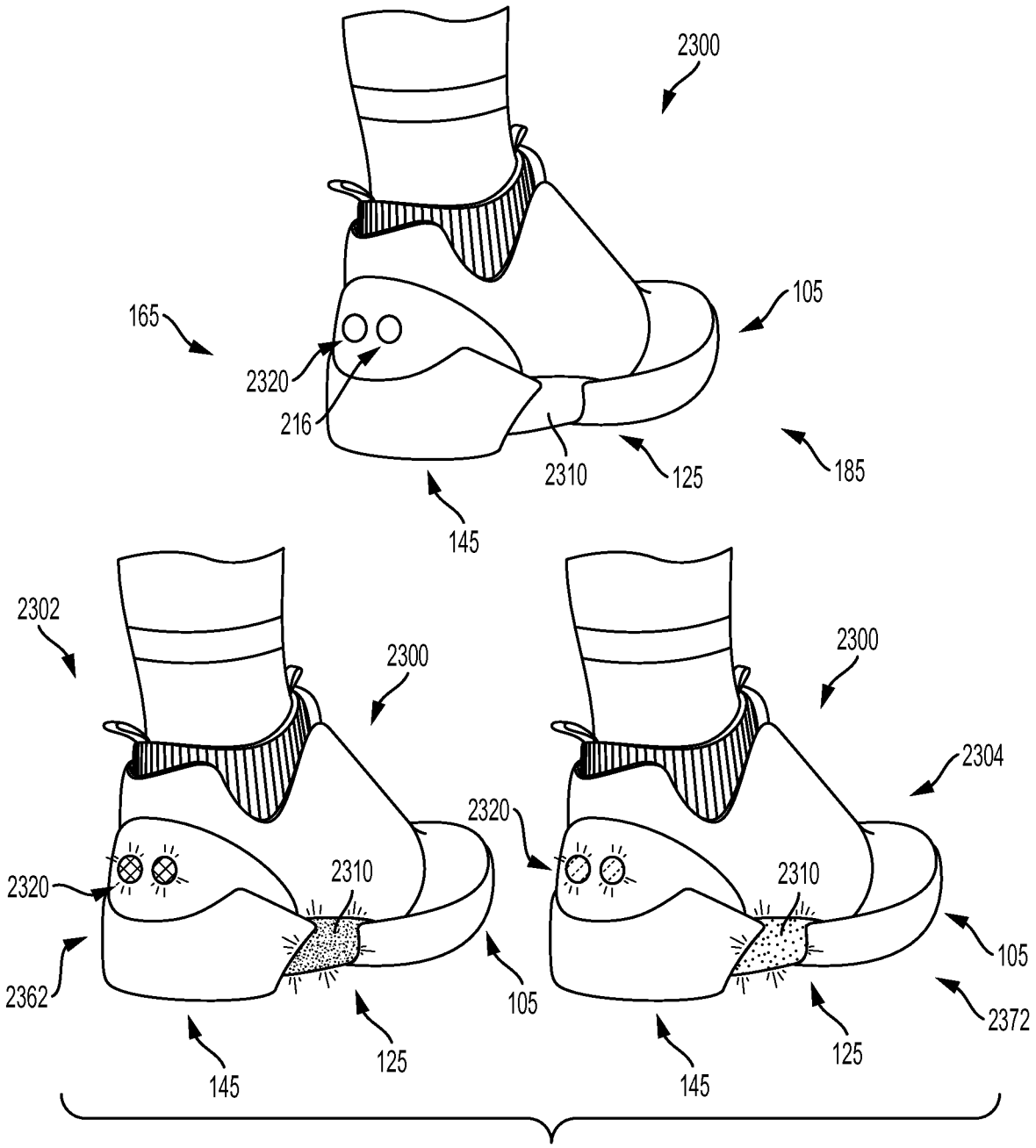
FIG. 23 is an illustration representing an embodiment of some animation operations of a tensioning system.

Thus, in some embodiments, an article can include provisions for the display of lights along a portion of the article. In some cases, light sources may be disposed along various regions of the article. In some embodiments, there may be one region that includes at least one light source. In other embodiments, there may be two or more regions with light sources. In the embodiment of FIG. 23, a third article 2300 is shown with two sets of light sources. A first set of lights ("first set") 2310 is associated with midfoot region 125, and a second set of lights ("second set") 2320 is associated with heel region 145. In different embodiments, there may be only first set 2310 or only second set 2320. In other embodiments, there may be additional sets of lights.

In FIG. 23, first set 2310 comprises a series of light sources that are disposed along lateral side 185 near the ECU (as discussed with respect to FIG. 2) while second set 2320 comprises a series of light sources disposed adjacent to heel counter 216 of third article 2300. In different embodiments, the light sources can be "RGB" s, such that they may provide light that can be red (R), green (G), blue (B), or any color combination of the RGB colors. The type of light source included in an article may vary in different embodiments. In some embodiments, first set 2310 may include a series of at least 20 light emitting diodes (LEDs) that can emit light. In other embodiments, first set 2310 includes between 35-45 LEDs. In one embodiment, there may be 40 LEDs in first set 2310. In some cases, all or multiple LEDs of first set 2310 may be linked together to emit light in a substantially simultaneous or sequential manner. In one case, first set 2310 and/or second set 2320 may comprise a printed circuit board and assembly (PCBA).

In some cases, second set 2320 may include at least one LED that can emit light. In other embodiments, second set 2320 includes between two and 10 LEDs. In one embodiment, there may be five LEDs in second set 2320. In some cases, second set 2320 may include a series of discrete RGB light sources. In embodiments where at least two of the light sources of second set 2320 are discrete, the light display along heel region 145 may be programmed to simulate a movement of light. For example, where second set 2320 generally extends from lateral side 185 to medial side 165 of heel counter 216, there may be one or more display patterns programmed that can turn on each light in a sequence from lateral side 185 of heel counter 216 to medial side 165 of heel counter 216, or from medial side 165 of heel counter 216 to lateral side 185 of heel counter 216. Thus, in some embodiments, each of the LEDs may be individually controllable, allowing a pulsing pattern to emanate from heel region 145.

The light sources included in an article can be used to create an "animation" in some embodiments. For purposes of this disclosure, an animation is a pattern or sequence of light display that can play or run at the command of the automated tensioning system. Animations may provide a user with information regarding the status of the tensioning system in some embodiments. In other embodiments, an animation can provide entertainment or aesthetically attractive patterns, or respond to activities or performance patterns of the user.

In some embodiments, the tensioning system can include different types of animations. For example, the automated tensioning system may be able to select or display an animation based on the operation being performed by the system. As shown in FIG. 23, during a first operation 2302, in one embodiment, during tightening (e.g., the tighten state) of third article 2300, a first animation 2362 may be displayed. As another example, during a second operation 2304 such as loosening (e.g., the loosen state), a second animation 2372 may be displayed along third article 2300. In some embodiments, first animation 2362 may be different from second animation 2372 in any of pattern of display, duration of display, color, brightness, and other features. In other embodiments, one or more operations performed by the tensioning system may be associated with an animation.

Furthermore, in some cases, an animation may be categorized by its display priority, discussed further below. For purposes of providing greater clarity to the reader with respect to some of the animations that can be included, FIG. 24 lists an embodiment of 10 different animation events and their associated operations. It should be understood that, in different embodiments, there may be additional, fewer, and/or different animations included in the tensioning system than those listed in FIG. 24. Thus, FIG. 24 lists only some examples of various animations that may be displayed.

FIG. 24 includes first animation 2362, second animation 2372, a third animation 2430, a fourth animation 2440, and a fifth animation 2450 in a first table 2402. In addition, a second table 2404 includes a sixth animation 2460, a seventh animation 2470, an eighth animation 2480, a ninth animation 2490, and a tenth animation 2400. Referring to first table 2402, in some embodiments, first animation 2362 is associated (e.g., programmed to be displayed) with the tightening operations of an article, and second animation 2372 is associated with loosening operations of an article. Furthermore, in some embodiments, third animation 2430 is associated with automated unlacing, fourth animation 2440 is associated with the successful completion of autolacing, and fifth animation 2450 is associated with the successful return of the tensioning setting to the preset level.

In addition, referring to second table 2404, in some embodiments, sixth animation 2460 can be associated with an acknowledgement that the existing tension level has been successfully saved in memory as a new preset setting, and seventh animation 2470 is associated with a notification that the existing tension level has not been successfully saved as a new preset setting. Furthermore, in some embodiments, there may be animations associated with the battery operations of the system (described further below). In some embodiments, eighth animation 2480 can indicate a low battery state. In another embodiment, ninth animation 2490 can indicate a fully charged battery state, and tenth animation 2400 is associated with a successful reset of the system.

Referring to first table 2402 and second table 2404, in some embodiments, there may be distinctions between one animation and another that can help the system determine the order in which the animations should be displayed by an article. In one embodiment, some animations may be given priority in the display queue. For example, in some embodiments, at least some animations may be categorized as either "Background" (BG) animations or "Foreground" (FG) animations. For purposes of this disclosure, foreground animations are animations that can interrupt other types (non-foreground) of animations. In other words, if the automated tensioning system receives a command to play a first animation and then, before the first animation is complete, the system receives another command to play a second animation, the ordering of the animations can differ depending on the categorization associated with each of the animations. In one embodiment, if both of the animations are "Background" animations, the first animation and the second animation will be displayed sequentially (one after the other). Similarly, if in another embodiment both of the animations are "Foreground" animations, the first animation and the second animation will be displayed sequentially (one after the other). If, on the other hand, the second animation is a "Foreground" animation, but the first animation (currently being displayed by the article) is a "Background" animation, the second animation can interrupt the first animation, allowing the foreground animation to be displayed immediately, rather than waiting for the background animation to be completed.

As noted above, the tensioning system of some of the disclosed embodiments may include provisions for alerting a user to the status of a power source associated with the article. Thus, in one embodiment, the article of footwear can include the ability to detect the status of the power level of its battery. In some embodiments, there may be one or more states associated with low battery operations of an article, as represented by the diagram in FIG. 25. In one embodiment, there can be at least three low battery states 2500, including a laced low battery state ("laced") 2502, an unlaced low battery state ("unlaced") 2504, and the more transitory unlacing low battery state ("unlacing") 2506. In terms of the tensioning system, unlaced low battery state 2504 represents a specific condition in which the system recognizes that the article of footwear is fully unlaced and is otherwise not engaging in any normal operations. In one embodiment, the motor is inactive, and/or the FSR can be engaged in this state. Furthermore, laced low battery state 2502 can represent a specific condition in which the system recognizes that the article of footwear is fully laced (as tightly as the system will allow) or is otherwise in a generally static laced condition. This state can also be referred to as "Low Battery Unlacing (needed)" in some cases. In some embodiments, the determination that leads to a transition to either laced low battery state 2502 or the unlaced low battery state 2504 can be determined by a limit switch, as discussed above with respect to FIG. 4. In another embodiment, unlaced low battery state 2504 may be triggered when a predetermined safety timeout is exceeded. In some cases, the safety timeout can range between 5 seconds and 10 seconds. In one case, the safety timeout can be set for approximately 8 seconds. In other cases, the safety timeout can be greater than 5 seconds. However, in different embodiments, another sensor or device may be used to indicate the condition of the tensioning system.

Figure 25:
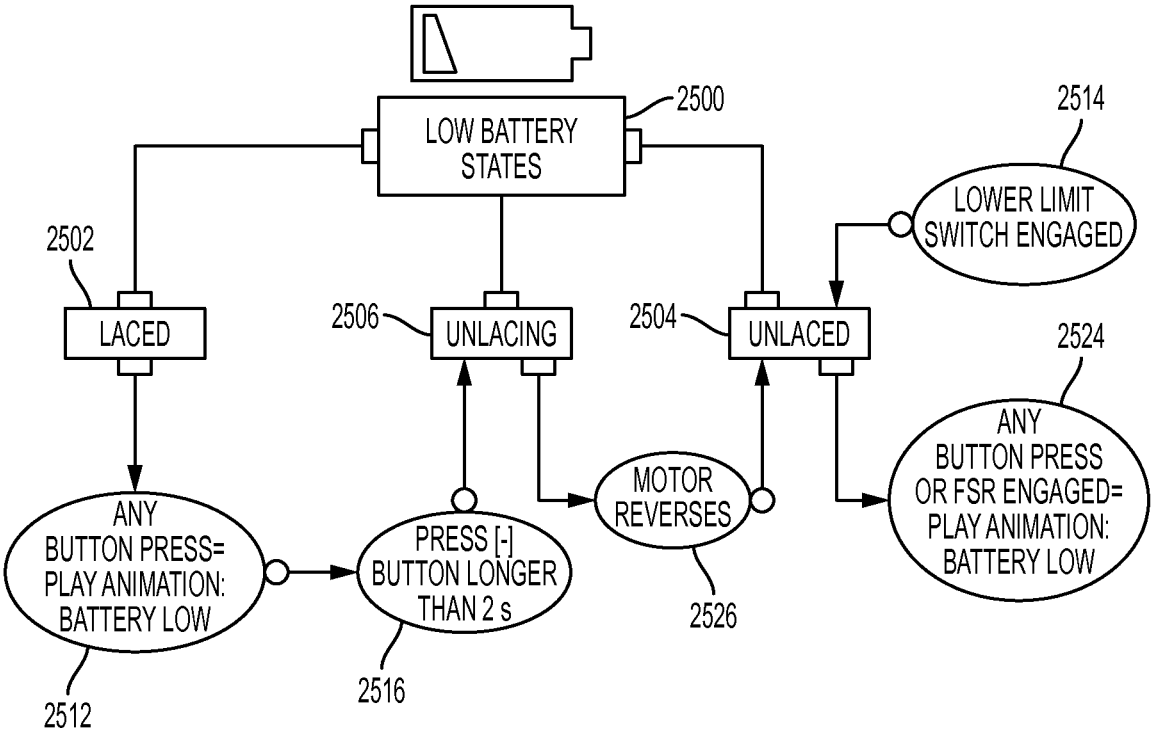
FIG. 25 is a flowchart representing an embodiment of some operations of a tensioning system.

As well as laced low battery state 2502 and unlaced low battery state 2504, during low battery operation there may be more transitory states that the article of footwear and its system may be in as they transition between the two primary low battery states. In one embodiment, unlacing low battery state 2506 can represent a specific condition in which the system recognizes that the article of footwear is being loosened during low battery functioning. In some embodiments, unlacing low battery state 2506 can represent loosening that occurs as a result of automated processes of the system following the depression of a button for greater than the predetermined duration of time. For example, depression of a button for longer than 2 seconds ("press [−] button longer than 2 s") 2516 may initiate a transition to unlacing low battery state 2506, in which the motor reverses, and the article reaches unlaced low battery state 2504 and is fully loosened. This may permit a user to more easily remove a foot from the article in some cases. In another embodiment, loosening may occur when the motor is moving in a reverse direction ("motor reverses") event 2526 through manual controls, as discussed above. In some cases, motor reverses event 2526 may lead to low battery unlaced state 2504, as shown in FIG. 25. In one embodiment, low battery unlaced state 2504 can be associated with a recognition by the system that the lower limit switch has engaged ("lower limit switch engaged") 2514.

Each of low battery states 2500 can be associated with different events. For example, in some embodiments, when an article of footwear is in laced low battery state 2502, if a user presses or interacts with any of the manual controls, the article may initiate a low battery animation ("any button press=play animation: battery low") 2512, as discussed with respect to FIGS. 23 and 24 above). Similarly, in some embodiments, when an article of footwear is in unlaced low battery state 2504, if a user presses or interacts with any of the manual controls and/or the FSR (which may remain enabled in low battery states, even though the motor is inactive), the article may initiate a low battery animation ("any button press or FSR engaged=play animation: battery low") 2524. This type of animation response can notify the user that the article may not be fully powered or that the article is ready for charging. In some embodiments, during low battery operation, there may be one or more animations displayed to a user. In one embodiment, the low battery animations may be prioritized relative to other animations, as discussed above in the discussion regarding foreground and background animations. In other embodiments, once the article is in unlaced low battery state 2504, any further interaction with a manual control button and/or the FSR can lead to a low battery animation display.

Furthermore, in some embodiments, there may also be a process that can be described as "Low Battery Behavior." When the article is engaged in Low Battery Behavior, the system can discontinue animation playback after a certain number of playback or display events. In some cases, this may help conserve battery power. In one embodiment, this can be used to limit repeated or constant blinking lighting activity, which would otherwise occur each time a button depress or activation of the FSR sensor occurred. In some cases, the low battery animation may be displayed only once.

In different embodiments, the low battery states can be designed to provide a user with information regarding the system power status, as well as provide the article with sufficient power to loosen the article even when it has reached a low battery state, and allow the user to more readily remove the article. In other embodiments, these states may be optional, or there may be fewer or additional states.

Figure 26:
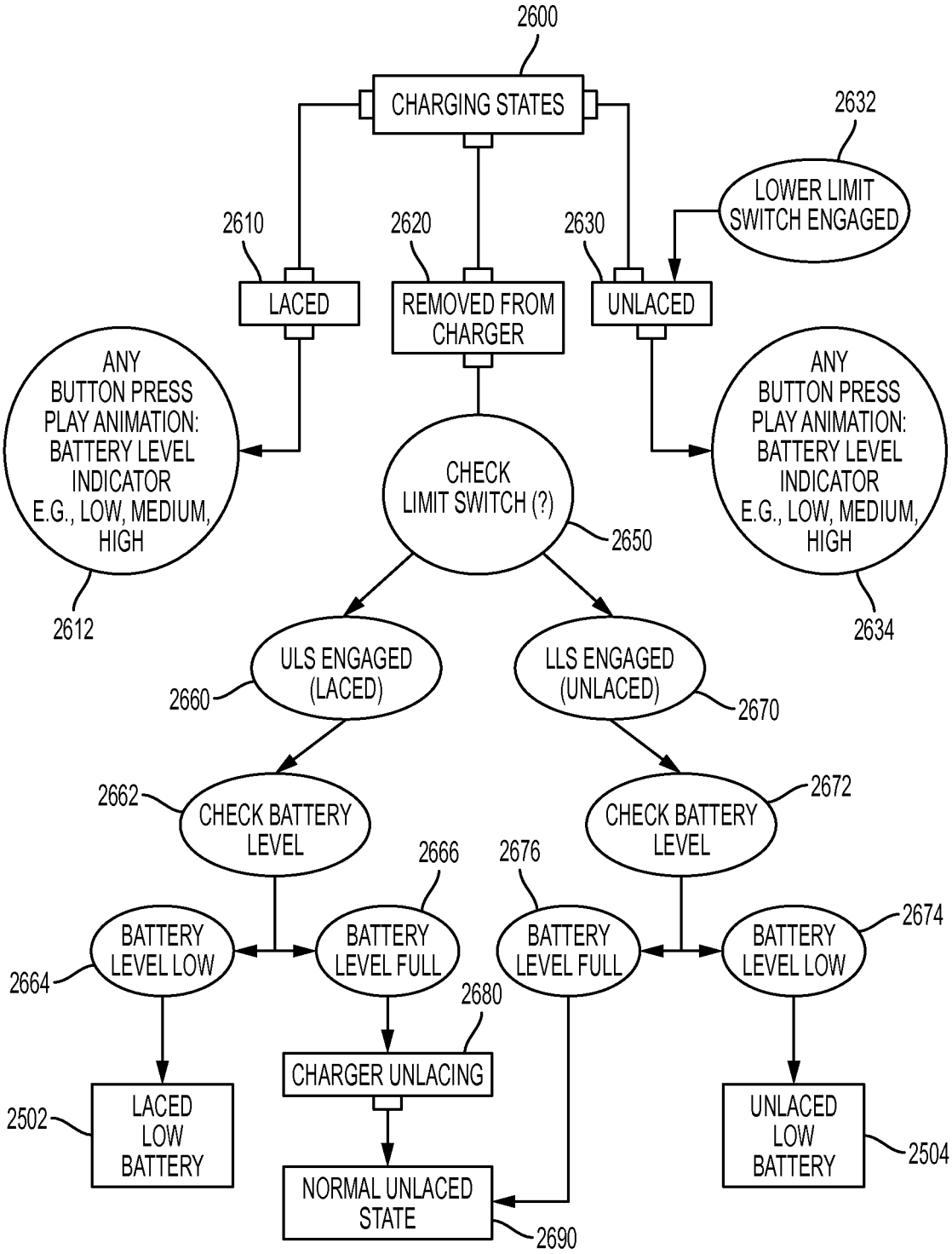
FIG. 26 is a flowchart representing an embodiment of some operations of a tensioning system.

In some embodiments, the article of footwear may include provisions for charging a battery or other power source. In different embodiments, when a user has connected the article to a charging source, there may be one or more states associated with various charging operations of an article, as represented by the diagram in FIG. 26. In one embodiment, there can be at least four charging states 2600, including a laced charging state 2610, an unlaced charging state 2630, and a removed from charger state 2620. It should be understood that in other embodiments, these states may be optional, or there may be fewer or additional states.

In terms of the tensioning system, unlaced charging state 2630 represents a specific condition in which the system recognizes that the article of footwear is fully unlaced and is connected to the charger. In some cases, the fully unlaced state of unlaced charging state 2630 may be detected by the engagement of the lower limit switch ("lower limit switch engaged") 2632. Furthermore, laced charging state 2610 can represent a specific condition in which the system recognizes that the article of footwear is fully laced (as tightly as the system will allow) or is otherwise in a generally static laced condition during charging.

In addition, removed from charger state 2620 may represent the condition of the article immediately after being removed from its charger. In some embodiments, a limit switch may determine which pathway the system will apply when the article is removed from the charger. In some embodiments, if the article is in removed from charger state 2620, the system may check the status of the limit switch ("check limit switch") 2650. For example, if the upper limit switch is engaged ("ULS engaged (Laced)") 2660, the system may measure the battery level ("check battery level") 2662. If an article was removed from the charger prior to being sufficiently charged ("battery level low") 2664, the system may transition back to laced low battery state 2502 (see FIG. 25) in some embodiments. If, on the other hand, an article is removed from the charger and the battery has been sufficiently charged for normal operations ("battery level full") 2666, the system may initiate a shift to an unlaced state ("normal unlaced state") 2690 in one embodiment. In some embodiments, if an article is removed from the charger and the battery is sufficiently charged for normal operations, the system may begin to fully unlace the article if it had not been previously unlaced when charging had commenced. Thus, in some embodiments, an unlacing charging state ("charger unlacing") 2680 can occur after the article is removed from a charger and the upper limit switch (or another sensor) indicates to the system that the article has yet to loosen from laced charging state 2610 to an unlaced state ("normal unlaced state") 2690. In one embodiment, the article can shift from laced charging state 2610 to normal unlaced state 2690 via unlacing charger state 2680.

In another example, if the lower limit switch is engaged ("LLS engaged (Unlaced)") 2670, the system may measure the battery level ("check battery level") 2672. If an article was removed from the charger prior to being sufficiently charged ("battery level low") 2674, the system may transition back to unlaced low battery state 2504 (see FIG. 25) in some embodiments. If, on the other hand, an article is removed from the charger and the battery has been sufficiently charged for normal operations ("battery level full") 2676, the system may switch to normal operations and "normal unlaced state" 2690.

Furthermore, during either unlaced charging state 2630 or laced charging state 2610, any interaction or depression with manual control buttons (e.g., the plus or minus buttons) may trigger an evaluation of the battery's status in some embodiments. In some cases, the system can play an animation to indicate to a user what the status of the battery (power level) is. In one embodiment, the animation can indicate simply whether the battery is fully charged, or whether the battery is still being charged, as shown in "any button press=play animation: battery level indicator, e.g., low, medium, high" 2612 and "any button press=play animation: battery level indicator, e.g., low, medium, high" 2634. In other embodiments, there may be different levels of discrimination in any animations, and/or the display may indicate a more detailed or precise measurement of the power level. In some cases, there may be three animations that represent the levels of battery life (e.g., low, medium, and high battery life). Other embodiments can include animations designed to indicate more than three levels of battery life.

In some embodiments, the article of footwear may include provisions for restarting, rebooting, or reinitializing the automated tensioning system. In different embodiments, there may be an automatic or manual command that can initiate a reset function. In some embodiments, when a user has connected the article to a charging source, the tensioning system may allow a user to interact with manual controls to reset the system.

Figure 27:
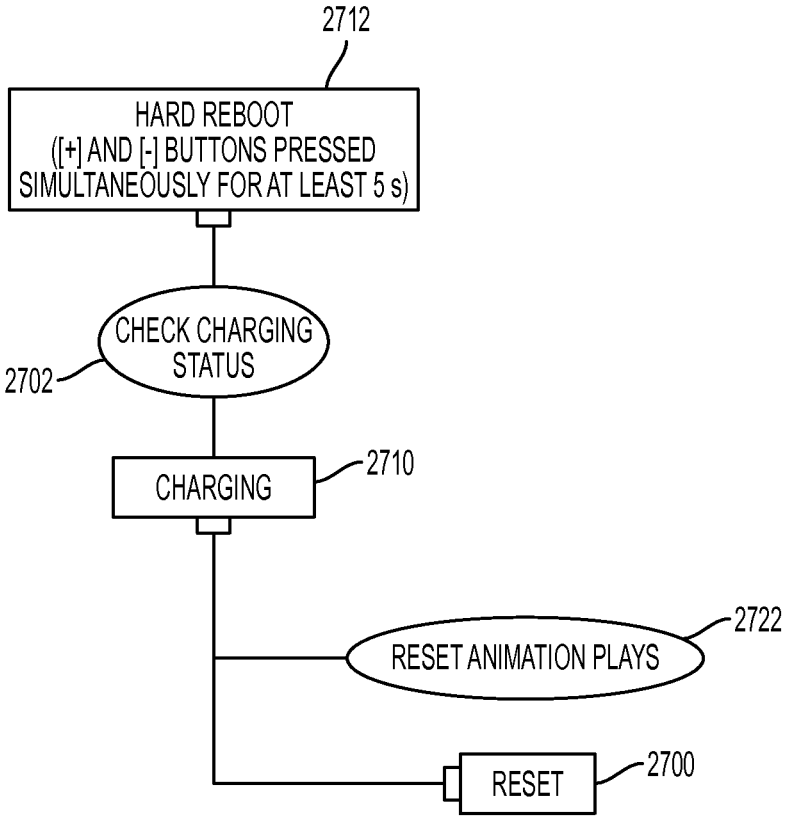
FIG. 27 is a flowchart representing an embodiment of some operations of a tensioning system.

Referring to the diagram of FIG. 27, there may be one or more states associated with the various reset operations of an article. It should be understood that in other embodiments, these states may be optional, or there may be fewer or additional states. In one embodiment, once the tensioning system is in a charging state ("charging") 2710, a user may be able to depress a manual control button to engage a reset event ("reset") 2700. In some embodiments, reset 2700 can be initiated by a hard reboot 2712 process. In one embodiment, depression of both first button and second button simultaneously for at least a predetermined threshold duration can lead to reset event 2700. In some cases, the predetermined threshold duration can be at least 2 seconds. In other cases, the predetermined threshold duration can be between 2 seconds and 10 seconds. In one case, the predetermined threshold duration can be approximately 5 seconds.

In some embodiments, upon registration of the command associated with reboot process 2712, the status of the battery ("check charging status" 2702) is evaluated. If charging is detected, then a reset of the system may occur in some cases. In one embodiment, an animation may be displayed on the article to notify the user that the reset event has been successfully initiated ("reset animation plays" 2722).

In some embodiments, reset event 2700 may return the automated tensioning system to default or factory settings. In other embodiments, the reset may only reboot (e.g., turn off and turn on) the automated tensioning system. In some embodiments, the reset can save any preset settings, while in another embodiment preset settings may not be stored following a reset.

It should be understood that the embodiments are not limited to a particular user interface or application for operating a motorized tensioning device or a tensioning system. The embodiments here are intended to be exemplary, and other embodiments could incorporate any additional control buttons, interface designs and software applications. The control buttons for initiating various operating commands can be selected according to various factors including ease of use, aesthetic preferences of the designer, software design costs, operating properties of the system, as well as possibly other factors. Furthermore, a variety of products, including apparel (e.g., shirts, pants, footwear), may incorporate an embodiment of the control device described herein, as well as other types of articles, such as bed coverings, table coverings, towels, flags, tents, sails, and parachutes, or articles with industrial purposes that include automotive and aerospace applications, filter materials, medical textiles, geotextiles, agrotextiles, and industrial apparel.

Furthermore, the embodiments described herein may also include or refer to techniques, concepts, features, elements, methods, and/or components from U.S. Patent Publication Number 2016-0345679-A1, published Dec. 1, 2016, (previously U.S. patent application Ser. No. 14/723,972, filed May 28, 2015), titled "An Article of Footwear and a Method of Assembly of the Article of Footwear,"; U.S. Patent Publication Number 2016-0345653-A1, published Dec. 1, 2016, (previously U.S. patent application Ser. No. 14/723,832, filed May 28, 2015), titled "A Lockout Feature For A Control Device,"; U.S. Patent Publication Number 2016-0345654-A1, published Dec. 1, 2016, (previously U.S. patent application Ser. No. 14/723,880, filed May 28, 2015), titled "An Article Of Footwear and A Charging System for an Article of Footwear,"; U.S. Patent Publication Number 2016-0345671-A1, published Dec. 1, 2016, (previously U.S. patent application Ser. No. 14/723,994, filed May 28, 2015), titled "A Sole Plate for an Article of Footwear,"; and U.S. Patent Publication Number 2016-0345655-A1, published Dec. 1, 2016. (previously U.S. patent application Ser. No. 14/724,007, filed May 28, 2015), titled "A Control Device for an Article of Footwear,", the disclosures of each application being herein incorporated by reference in their entirety.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, comprising:

a motorized tensioning system that is configured to adjust a tension level of the article of footwear from a first tension level to a second tension level, wherein the first tension level is greater than the second tension level;

the motorized tensioning system including a motor, a controller coupled to the motor, and a memory coupled to the controller;

wherein there is a first current level associated with operating the motor when the article of footwear is tensioned at the first tension level, wherein there is a second current level associated with operating the motor when the article of footwear is tensioned at the second tension level;

wherein the first current level is different from the second current level; and wherein the controller is configured to drive the motor in a reverse direction, then in a forward direction, then measure current levels that are associated with operation of the motor in order to determine the tension level of the article of footwear, wherein the current levels are measured after the motor is driven in the forward direction.

2. The article of footwear of claim 1, further comprising:

a control device, coupled to the controller, the control device comprising a first button and a second button;

the control device being configured to provide manual control of the motorized tensioning system; and wherein interaction with the first button initiates an increase in the tension level of the article of footwear.

3. The article of footwear of claim 2, wherein interaction with the second button initiates a decrease in the tension level of the article of footwear.

4. The article of footwear of claim 2, wherein the increase in the tension level of the article of footwear occurs while the motor operates in the forward direction.

5. The article of footwear of claim 4, wherein the decrease in the tension level of the article of footwear occurs while the motor operates in a reverse direction with an operation of the motor in the reverse direction.

6. The article of footwear of claim 1, wherein an increase in a current level associated with operating the motor corresponds with an increase in the tension level of the article of footwear.

7. The article of footwear of claim 1, wherein the first current level is greater than the second current level.

8. An article of footwear, comprising:

an automated tensioning system that is configured to adjust a level of tension associated with the article of footwear;

the automated tensioning system including a motor, a controller coupled to the motor, and a memory coupled to the controller, wherein the motor operates in a first direction and a second direction, wherein the motor operates in the first direction as the level of tension is increased, wherein the motor operates in the second direction as the level of tension is decreased; and wherein the controller is configured to determine the level of tension of the article of footwear by operating the motor in the second direction, then in the first direction, then measuring a current level that is associated with the motor following operation of the motor in the second direction, wherein the current levels are measured after the motor is driven in the forward direction.

9. The article of footwear of claim 8, further comprising at least a first light source coupled to the controller, wherein the automated tensioning system is configured to display a first animation using the first light source during operation of the motor.

10. The article of footwear of claim 8, wherein the controller is configured to cause the motor to cease operating upon registration of a safety timeout by the automated tensioning system.

11. The article of footwear of claim 8, wherein operation of the motor in the first direction is correlated with an increase in the current level associated with the motor.

12. The article of footwear of claim 8, wherein operation of the motor in the second direction is correlated with a decrease in the current level associated with the motor.

13. The article of footwear of claim 8, wherein the controller is configured to save a preset level of tension in the memory, and wherein the controller is configured to operate the motor in order to adjust the level of tension of the article of footwear to the preset level of tension.

14. The article of footwear of claim 13, wherein the preset level of tension is saved by storing information regarding the current level associated with the preset level of tension.

15. The article of footwear of claim 8, wherein the controller determines the level of tension of the article of footwear by measuring the current level within 0.001 and 10 seconds of the motor operation in the second direction.

16. An article of footwear, comprising:

a fastening mechanism associated with two or more tension levels;

an automated tensioning system configured to adjust the tension level of the fastening mechanism from a first tension level to a second tension level, wherein the first tension level is different from the second tension level;

the automated tensioning system including a motor, a controller coupled to the motor, and a memory coupled to the controller;

the automated tensioning system being configured to store the first tension level in the memory;

the automated tensioning system being configured to operate the motor such that the tension level of the fastening mechanism returns to the first tension level automatically;

and wherein the controller is configured to use a measurement of a current that is associated with operation of the motor following operating the motor in a reverse direction and then a forward direction to determine the tension level of the article, wherein the current levels are measured after the motor is driven in the forward direction.

17. The article of footwear of claim 16, further including a sensor coupled to the controller, wherein activation of the sensor initiates a command to the automated tensioning system to return to the first tension level.

18. The article of footwear of claim 17, wherein the sensor is a force sensitive resistor disposed in a heel region of the article of footwear.

19. The article of footwear of claim 16, further including a control device, coupled to the controller, wherein interaction with the control device can initiate a command to the automated tensioning system to return to the first tension level.

20. The article of footwear of claim 19, wherein the control device includes a first button and a second button, and wherein depression of both the first button and the second button for longer than a predetermined threshold duration initiates the command to the automated tensioning system to save a current tension level in the memory.

21. The article of footwear of claim 20, wherein the predetermined threshold duration is between 2 seconds and 4 seconds.

22. The article of footwear of claim 16, wherein the first tension level is stored by measurement and storage of a current level that is associated with an operation of the motor that adjusts the tension level of the article of footwear to the first tension level.

23. A controller-implemented method, comprising:

operating a motor to adjust a tension level of an article of footwear to a first tension level;

operating the motor in a reverse direction; then operating the motor in a forward direction; then measuring a first current level associated with the operation of a motor during the adjustment to the first tension level;

storing the first current level in memory;

determining the first tension level based on the first current level;

operating the motor to adjust the tension level of the article of footwear to a second tension level that is different from the first tension level;

returning the tension level of the article of footwear to the first tension level.

24. The method of claim 23, further comprising:

measuring a second current level associated with the operation of the motor during the adjustment to the second tension level; and determining the difference between the first current level and the second current level.

25. The method of claim 24, further comprising storing the second tension level in memory.

26. The method of claim 23, wherein the step of returning the tension level of the article of footwear to the first tension level occurs in response to an input being registered by a sensor.

27. The method of claim 23, wherein the step of returning the tension level of the article of footwear to the first tension level occurs in response to registration of an input into a control device.

* * * * *